US011287187B2

(12) United States Patent
Puckett

(10) Patent No.: US 11,287,187 B2
(45) Date of Patent: Mar. 29, 2022

(54) METHODS AND SYSTEMS FOR DRYING SOFTGELS WITH HYDROPHILIC FILLS

(71) Applicant: BARLEAN'S ORGANIC OILS, LLC, Ferndale, WA (US)

(72) Inventor: John Puckett, Ferndale, WA (US)

(73) Assignee: Barlean's Organic Oils, LLC, Ferndale, WA (US)

( * ) Notice: Subject to any disclaimer, the term of this patent is extended or adjusted under 35 U.S.C. 154(b) by 0 days.

(21) Appl. No.: 17/021,761

(22) Filed: Sep. 15, 2020

(65) Prior Publication Data

US 2021/0071951 A1 Mar. 11, 2021

Related U.S. Application Data

(63) Continuation of application No. 16/833,062, filed on Mar. 27, 2020, now Pat. No. 10,809,004.

(60) Provisional application No. 62/824,478, filed on Mar. 27, 2019.

(51) Int. Cl.

| | |
|---|---|
| ***F26B 21/08*** | (2006.01) |
| ***F26B 3/04*** | (2006.01) |
| ***F26B 17/02*** | (2006.01) |
| ***F26B 25/22*** | (2006.01) |
| ***F26B 21/12*** | (2006.01) |
| ***F26B 25/14*** | (2006.01) |
| ***F26B 21/10*** | (2006.01) |

(52) U.S. Cl.

CPC ..... *F26B 21/08* (2013.01); *F26B 3/04* (2013.01); *F26B 17/02* (2013.01); *F26B 21/10* (2013.01); *F26B 21/12* (2013.01); *F26B 25/14* (2013.01); *F26B 25/22* (2013.01)

(58) Field of Classification Search

CPC .... F26B 21/08; F26B 3/00; F26B 3/04; F26B 17/00; F26B 17/02; F26B 21/00; F26B 21/10; F26B 21/12; F26B 25/14; F26B 25/22

USPC ..... 34/540

See application file for complete search history.

(56) References Cited

U.S. PATENT DOCUMENTS 1,536,806 A * 5/1925 Merrill ..... F26B 11/0436 34/480
3,529,043 A * 9/1970 Yen ..... A61J 3/07 264/15

(Continued)

FOREIGN PATENT DOCUMENTS

CA 2525166 A1 * 5/2006 ..... F26B 17/02
CA 2687578 A1 ‡ 1/2009 ..... F04B 49/06

(Continued)

*Primary Examiner* — Stephen M Gravini
(74) *Attorney, Agent, or Firm* — FisherBroyles, LLP

(57) ABSTRACT

Provided herein are systems, methods, and processes for drying a softgel having a hydrophilic fill material and one or more active ingredients. After forming the hydrophilic softgel, for example, the softgel is dried by sequentially passing the softgel through a series of specific drying conditions, in which the first drying condition has a low temperature and low dew point. In certain examples, controlled airflow is also used to dry the softgels. By using the systems, methods, and processes, the total time to dry the hydrophilic softgel can be beneficially reduced from several days to about 24 hours without causing shriveling of the softgel.

20 Claims, 12 Drawing Sheets

(56) References Cited

U.S. PATENT DOCUMENTS

| | | | | |
|---|---|---|---|---|
| 6,195,911 | B1 * | 3/2001 | Brehant | A23G 3/24 34/463 |
| 8,621,764 | B2 * | 1/2014 | Puckett | A23L 29/284 34/443 |
| 9,015,960 | B2 ‡ | 4/2015 | Hopkin | F26B 9/02 34/417 |
| 9,638,464 | B2 ‡ | 5/2017 | Puckett | F26B 11/0436 |
| 9,795,538 | B2 ‡ | 10/2017 | Puckett | A61J 3/07 |
| 10,001,322 | B2 ‡ | 6/2018 | Puckett | F26B 11/0436 |
| 10,195,115 | B2 * | 2/2019 | Puckett | A61J 3/07 |
| 10,677,528 | B2 * | 6/2020 | Puckett | H05K 999/99 |
| 10,809,004 | B1 * | 10/2020 | Puckett | F26B 21/10 |
| 2006/0070254 | A1 * | 4/2006 | Victorov | F26B 11/181 34/58 |
| 2008/0000099 | A1 * | 1/2008 | Victorov | F26B 11/181 34/129 |
| 2021/0071951 | A1 * | 3/2021 | Puckett | F26B 21/10 |

FOREIGN PATENT DOCUMENTS

| | | | | |
|---|---|---|---|---|
| DE | 10001322 | B4 ‡ | 3/2011 | B41F 27/1206 |
| EP | 1464628 | A1 * | 10/2004 | F26B 3/286 |
| EP | 2687578 | A1 ‡ | 1/2014 | C07C 1/02 |
| JP | 5735105 | B2 ‡ | 6/2015 | A61B 1/0684 |
| WO | WO-2005019752 | A1 * | 3/2005 | B65G 47/19 |

* cited by examiner
‡ imported from a related application

ZONE 2

METHODS AND SYSTEMS FOR DRYING SOFTGELS WITH HYDROPHILIC FILLS

RELATED APPLICATIONS

This application is a continuation of U.S. patent application Ser. No. 16/833,062, filed Mar. 27, 2020, which claims the benefit of U.S. Provisional Application No. 62/824,478, filed Mar. 27, 2019, each of which is incorporated herein in its entirety.

FIELD OF THE INVENTION

The present invention relates generally to a gelatin capsule manufacturing and drying processes, and more particularly to drying softgels with hydrophilic fill materials.

BACKGROUND OF THE INVENTION

The gelatin capsule or "softgel" is a one-piece, hermetically sealed soft gelatin shell containing a liquid, a suspension, or a semi-solid fill material. Softgels can be formed by a variety or processes. In the conventional rotary die process, a heated mixture of gelatin, water, glycerol and other components are used to form two flexible gelatin sheets or ribbons. The ribbons are then synchronously guided between two mated dies. A pump simultaneously delivers the fill material into a heated wedge that sits between the rotary dies. The pump injects fill material into the die cavities between the ribbons just before the die rolls cut the ribbons and seals the two cut halves of the ribbon together to form a softgel. The warm, newly-formed softgels are then collected as they exit the dies and dried. The dried softgels are then packaged for shipment to the customer.

One challenge for softgel manufacturers is the length of time it takes to dry the softgel shell to a hardness where the softgel can be packaged. Because the composition of the softgel walls and the fill material can be different—including different water contents—care must be taken when drying the softgels so that they retain their structural integrity and appearance well after they are packaged and sold to consumers. With fills that include hydrophobic components, such as fish oils or other oils, water within the fill material migrates from the fill material to the softgel walls during the drying process. The water then migrates from the softgel walls out to the environment surrounding the softgel, the softgel eventually reaching a water migration equilibrium. To expedite the drying process, softgels can be dried using drying tunnels in which the softgels are placed on trays and slowly dried over several days. In other, more recent drying techniques, softgels with hydrophobic fills can be dried much faster using a series of drying zones and tumble driers.

While care must be taken to dry softgels having hydrophobic fills, drying softgels that include hydrophilic fill material has proven substantially more challenging. This is because water does not naturally migrate from the hydrophilic fill material towards the softgel shell, but rather tends to remain within the fill material (or even migrate from the shell towards the hydrophilic fill material). Hence, a longer drying time is needed to dry softgels with hydrophilic fills, as drying such softgels too quickly can result in irregularly-shaped softgels that have a raisin-like (shriveled) appearance and that lack structural integrity. As such, softgels with hydrophilic fills are dried using conventional drying tunnels as described above. For example, softgels that include polyethylene glycol (PEG)—a highly hydrophilic material—are conventionally dried by placing the softgels in a drying tunnel for 5-7 days, thereby allowing the softgels to very slowly achieve a water migration equilibrium. Such lengthy drying times, however, can decrease manufacturing efficiency and decrease product shelf-life.

Because of the time commitment needed to dry softgels having a hydrophilic fill material, what is needed are methods and systems that shorten the overall drying time for such softgels. For example, what is needed are methods and systems that permit softgels with hydrophilic fills to be dried quickly, but that do not result in irregularly-shaped softgels or softgels with structural integrity issues. Also needed are methods and systems to dry softgels having a hydrophilic fill material that reduce manufacturing time and that hence maintain maximum product shelf-life.

SUMMARY

In certain example aspects described herein, a method of drying a softgel comprising a hydrophilic fill is provided. A space is divided into a first drying zone (zone 1), a second drying zone (zone 2), and a third drying zone (zone 3). Each drying zone is then adjusted to a specific drying condition, i.e., zone 1 includes a temperature of about 35-45° F., a relative humidity of about 15-22%, and a dew point of about 0-8° F., while zone 2 includes a temperature of about 60-67° F., a relative humidity of about 9-14%, and a dew point of about 0-16° F. Zone 3 includes a temperature of about 68-74° F., a relative humidity of about 10-15%, and a dew point of about 10-23° F. To dry the hydrophilic softgel, the hydrophilic softgel is sequentially moved into and through zone 1, into and through zone 2, and into and through zone 3, thereby drying the softgel. The drying is complete within 24 hours or less. In certain example aspects, drying is complete within about 15 hours. For example, the softgel can spend about two hours in zone 1, about 10 hours in zone 2, and about three hours in zone 3. And to facilitate the drying process, in certain example aspects 5-15% sorbitol is included in the softgel shell.

In certain example aspects, airflow can be used to dry the hydrophilic softgels. For example, a first air handler unit for discharging air into zone 1 can output air into zone 1 at about 4,000-7,000 cubic feet per minute (CFM). A second air handler unit for discharging air into zone 2 can output air into zone 2 at about 4,000-7,000 CFM. And, a third air handler unit for discharging air into zone 3 can output air into zone 3 at about 1,000-3,000 CFM. Each air handler, for example, can condition the air before discharging the air into the specific zones, such as by adjusting the humidity and temperature of the air and hence maintaining the temperature and humidity of the air in each zone.

In certain example aspects, provided is a system for drying a softgel encapsulating a hydrophilic fill. The system includes a structure divided into first, second and third zones. A first air handler unit is positioned to discharge air into the first zone, the first air handler maintaining a temperature of zone 1 of about 35-45° F., a relative humidity of zone 1 of about 15-22%, and a dew point of zone 1 of about 0-8° F. Further, a second air handler unit is positioned to discharge air into the second zone, the second air handler maintaining a temperature of zone 2 of about 60-67° F., a relative humidity of zone 2 of about 9-14%, and a dew point of zone 2 of about 0-16° F. And, a third air handler unit is positioned to discharge air into the third zone, the third air handler maintaining a temperature of zone 3 of about 68-74° F., a relative humidity of zone 3 of about 10-15%, and a dew point of zone 3 of about 10-23° F. The system can also include a series of tumble dryers that extend from the first zone, through the second zone and into the third zone. In certain example aspects, the first air handler unit outputs air into zone 1 at about 5,500 CFM, the second air handler unit outputs air into zone 2 at about 5,500 CFM, and the third air handler unit outputs air into zone 3 at about 2,000 CFM. The system can be used, for example, to dry a hydrophilic softgel in less than about 24 hours, and in certain example aspects in about 15 hours.

In certain example aspects, provided is a process for drying a hydrophilic softgel. The process includes exposing a hydrophilic softgel to a first condition, the first condition including a temperature of about 35-45° F., a relative humidity of about 15-22%, and a dew point of about 0-8° F. After exposing the hydrophilic softgel to the first condition, the hydrophilic softgel is exposed to a second condition, the second condition including a temperature of about 60-67° F., a relative humidity of about 9-14%, and a dew point of about 0-16° F. Then, after exposing the hydrophilic softgel to the second condition, the hydrophilic softgel is exposed to a third condition, the third condition including a temperature of about 68-74° F., a relative humidity of about 10-15%, and a dew point of about 10-23° F. Exposing the hydrophilic softgel to the first, second, and third conditions results in drying of the hydrophilic softgel within a 24-hour period, and, in certain aspects, the drying time is reduced to about 15 hours. For example, the hydrophilic softgel can spend about two hours in zone 1, about 10 hours in zone 2, and about three hours in zone 3. And to facilitate the drying process, in certain example aspects 5-15% sorbitol is included in the softgel shell. In certain example aspects, the first condition can also include an airflow movement of about 4,000-7,000 CFM, the second condition includes an airflow movement of about 4,000-7,000 CFM, and the third condition includes an airflow movement of about 1,000-3,000 CFM.

These and other aspects, objects, features and advantages of the example embodiments will become apparent to those having ordinary skill in the art upon consideration of the following detailed description of illustrated example embodiments.

DETAILED DESCRIPTION OF THE EXAMPLE EMBODIMENTS

Figure 1:
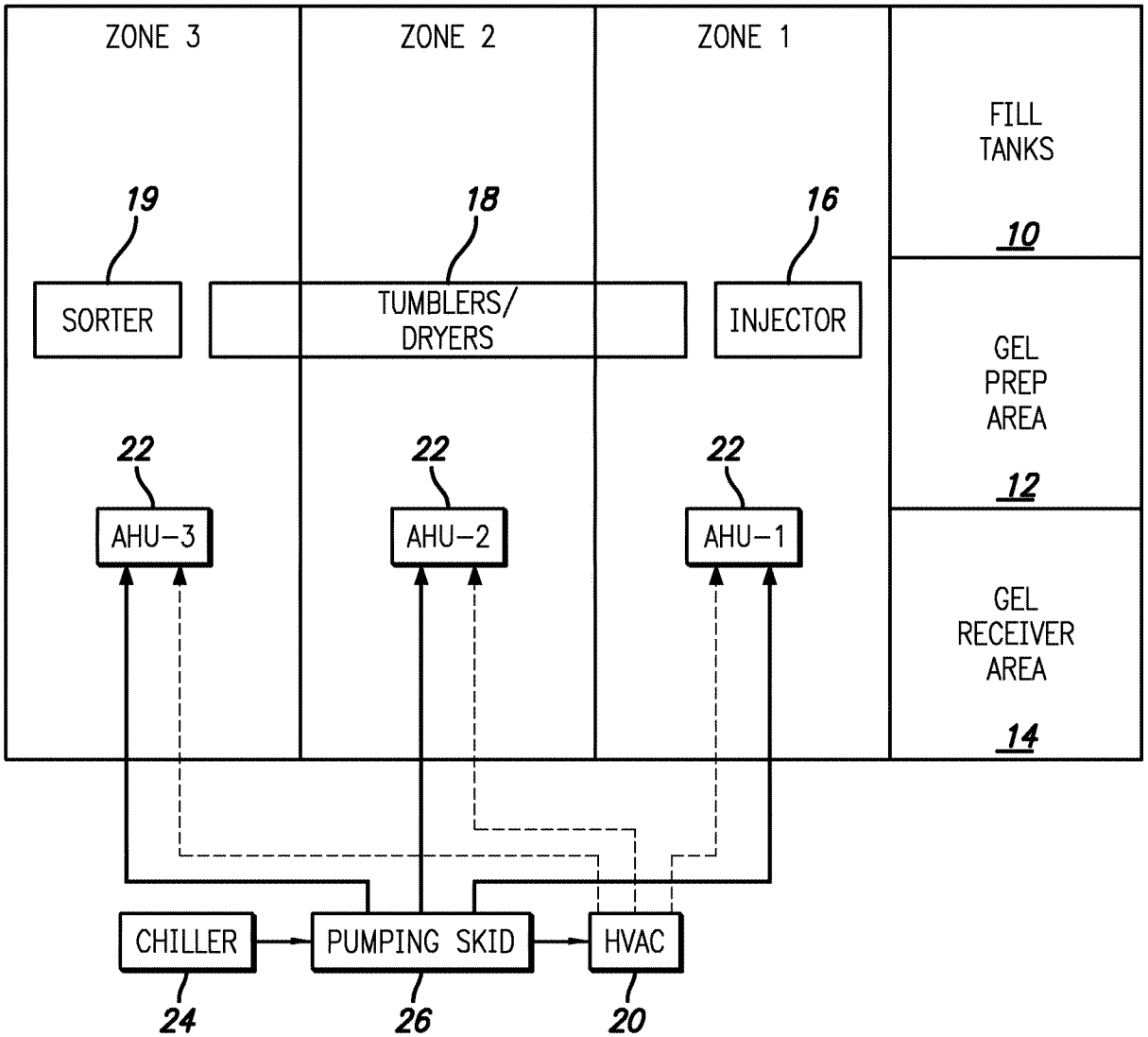
FIG. 1 is a schematic showing a three-zone drying system, in accordance with certain example embodiments.
Figure 2:
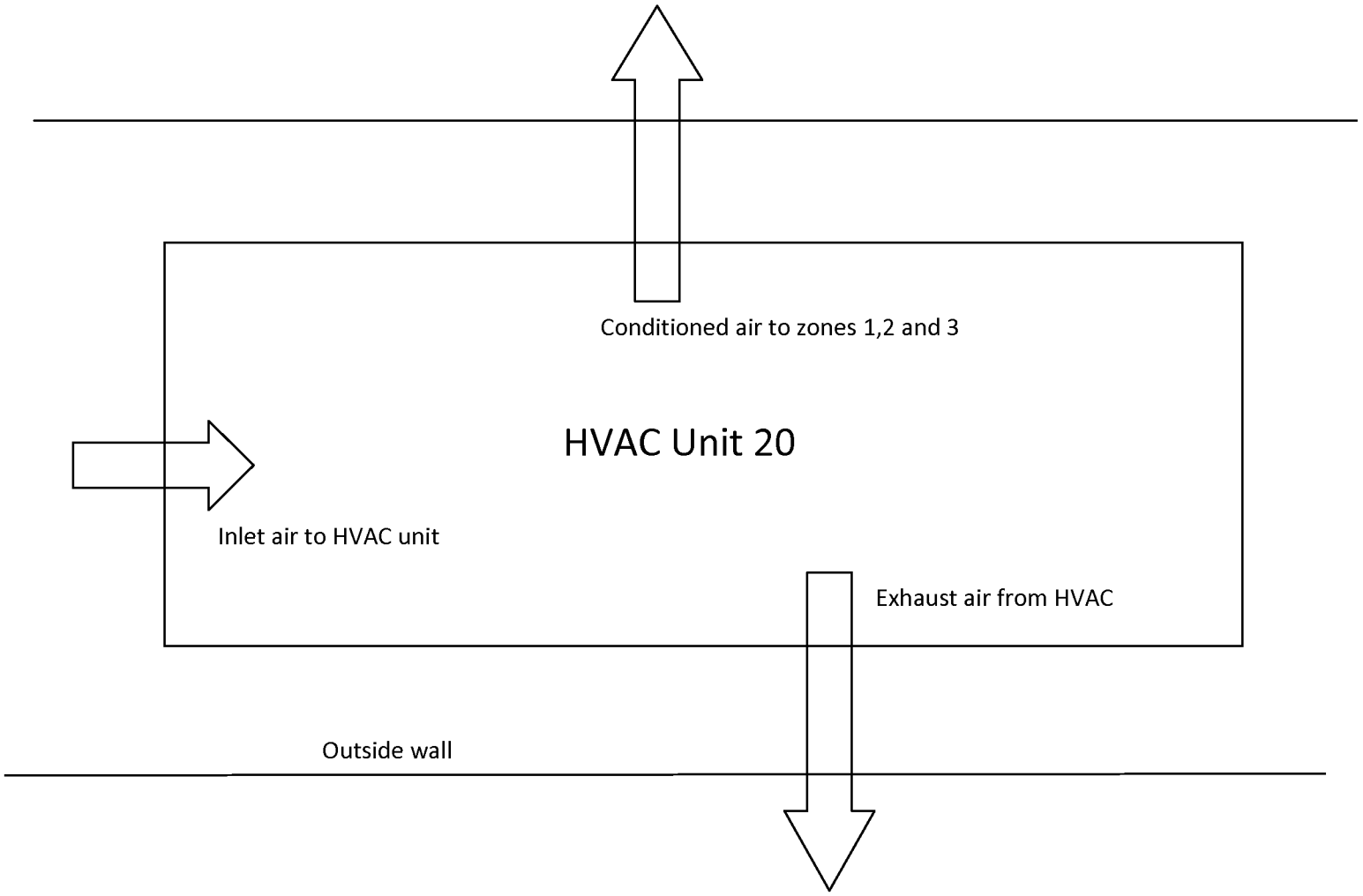
FIG. 2 is a schematic showing the HVAC unit of the drying system of FIG. 1, in accordance with certain example embodiments.

The following description and drawings are illustrative and are not to be construed as limiting. Numerous specific details are described to provide a thorough understanding of the disclosure. In certain instances, however, well-known or conventional details are not described in order to avoid obscuring the description. References to one or an embodiment in the present disclosure can be, but not necessarily, are references to the same embodiment; and, such references mean at least one of the embodiments.

Terminology

Reference in this specification to "one embodiment" or "an embodiment" means that a particular feature, structure, or characteristic described in connection with the embodiment is included in at least one embodiment of the-disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Unless the context clearly requires otherwise, throughout the description and the claims, the words "comprise," "comprising," "including" and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," and "below" used herein are merely for ease of description and refer to the orientation of the components as shown in the figures. It should be understood that any orientation of the components described herein is within the scope of the present invention.

As used herein, the singular forms "a," "an" and "the" include plural referents unless the context clearly dictates otherwise. Thus, for example, reference to a "softgel" includes aspects having two or more softgels unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance can or cannot occur, and that the description includes instances where said event or circumstance occurs and instances where it does not.

As used herein, the term "active ingredient" or "active agent" refers broadly to any agent, compound, or substance, compositions, or mixtures thereof, that provide, or that are intended to provide, a pharmacological, often beneficial, effect to the end user. Reference to a specific active ingredient includes, where appropriate, the active ingredient and any of its pharmaceutically acceptable salts or esters thereof. In certain example embodiments, the active ingredient is the only active ingredient in the pharmaceutical composition, whereas in other example embodiments the softgel includes one or more active ingredients. In certain example embodiments, the active ingredient can be present as a pharmaceutically acceptable salt of any of the pharmaceutical or nutraceutical ingredients described herein. The term "pharmaceutically acceptable salts" of an active ingredient includes, for example, alkali metal salts such as, for example, sodium or potassium salts, alkaline earth metal salts such as, for example, calcium and magnesium salts, and salts with organic or inorganic acid such as, for example, hydrochloric acid, hydrobromic acid, nitric acid, sulfuric acid, phosphoric acid, citric acid, formic acid, maleic acid, succinic acid, tartaric acid, methanesulphonic acid, toluenesulphonic acid etc. In certain example embodiments, the active ingredient may also be in the form of pharmaceutically acceptable salts, uncharged or charged molecules, molecular complexes, solvates, or anhydrates thereof, and, if relevant, single isomers, enantiomers, racemic mixtures, or mixtures thereof.

In certain example embodiments, the active pharmaceutical ingredient is one or more non-steroidal anti-inflammatory drugs (NSAID). Non-limiting examples of NSAID active pharmaceutical ingredients comprise aspirin, ibuprofen, aceclofenac, acemetacin, aloxiprin, azapropazone, benorilate, bromfenac, carprofen, celecoxib, choline magnesium salicylate, diclofenac, diflunisal, etodolac, etoricoxib, faislamine, fenbufen, fenoprofen, flurbiprofen, indometacin, ketoprofen, ketorolac, lornoxicam, loxoprofen, meloxicam, meclofenamic acid, mefenamic acid, meloxicam, metamizole, methyl salicylate, magnesium salicylate, nabumetone, naproxen, nimesulide, oxyphenbutazone, parecoxib, phenylbutazone, piroxicam, salicyl salicylate, sulindac, sulfinpyrazone, suprofen, tenoxicam, tiaprofenic acid, tolmetin, valdecoxib, or salts thereof. In certain example embodiments the active ingredient can be paracetamol (acetaminophen) or derivative thereof.

In certain example embodiments, the active ingredient is one or more NSAIDs combined or paracetamol with one or more cold, cough, allergy, nasal decongestant, antitussive, expectorant, antihistamine, stimulant, sedative, anti-inflammatory, antibiotic, anti-viral, anti-asthmatic, anti-migraine, hypnotic, narcotic analgesic, or narcotic antagonist active pharmaceutical ingredients, or further combinations thereof. For example, the active ingredient can be combined with one or more nasal decongestants, antitussives, expectorants, or antihistamines or a mixture or combination thereof. Suitable non-limiting nasal decongestants comprise pseudoephedrine, phenylephrine, and phenylpropanolamine or a mixture or combination thereof. Suitable non-limiting antihistamines comprise astemizole, azelastine, azatadine, brompheniramine, carbinoxamine, cetirizine, chlorpheniramine, clemastine, cyproheptadine, desloratadine, dexbrompheniramine, dexchlorpheniramine, diphenhydramine, fexofenadine, hydroxyzine, levocetirizine, loratadine, phenindamine, pheniramine, phenyltoloxamine, promethazine, pyrilamine, terfenadine, tripelennamine, triprolidine, or a mixture or combination thereof. Suitable non-limiting antitussives comprise acetyl dihydrocodeine, benproperine, benzonatate, benzylmorphine, bibenzonium bromide, butamirate, butorphanol, carbetapentane, chlophedianol, clobutinol, clofedanol, cloperastine, codeine, dextromethorphan, diacetylmorphine, dibunate, dihydrocodeine, dimemorfan, dimethoxanate, diphenhydramine, dropropizine, droxypropine, ethylmorphine, fedrilate, glaucine, hydrocodone, hydromorphone, isoaminile, laudanum, levodropropizine, levomethadone, levopropoxyphene, meprotixol, methadone, morclofone, nepinalone, nicocodine, nicodicodine, normethadone, noscapine, oxeladin, oxolamine, pentoxyverine, pholcodine, pipazetate, piperidione, prenoxdiazine, tipepidine, zipeprol, or a mixture or combination thereof. Suitable non-limiting expectorants and mucolytics comprise acetylcysteine, althea root, ambroxol, antimony pentasulfide, bromhexine, carbocisteine, cineole, combinations, combinations, creosote, dembrexine hydrochloride, domiodol, dornase alfa, eprazinone, erdosteine, guaiacolsulfonate, guaifenesin, hedera helicis folium, ipecacuanha, letosteine, levo verbenone, mannitol, mesna, neltenexine, potassium iodide, senega, sobrerol, stepronin, tiopronin, tyloxapol, or a mixture or combination thereof.

As used herein, a "carrier" refers to conventional pharmaceutically acceptable carriers. Remington's Pharmaceutical Sciences, by E. W. Martin, Mack Publishing Co., Easton, Pa., 19th Edition (1995), for example, describes compositions and formulations suitable for pharmaceutical delivery of an active ingredient. Conventional non-toxic carriers can include, for example, pharmaceutical grades of mannitol, lactose, starch, or magnesium stearate. In addition, pharmaceutical compositions can contain minor amounts of non-toxic auxiliary substances, such as wetting or emulsifying agents, preservatives, and pH buffering agents and the like, for example sodium acetate or sorbitan monolaurate.

Example carriers include excipients or stabilizers that are nontoxic to the cell, tissue, mammal, or subject being exposed thereto at the dosages and concentrations employed. Often the pharmaceutically acceptable carrier is an aqueous pH buffered solution. Examples of pharmaceutically acceptable carriers also include, without limitation, buffers such as phosphate, citrate, and other organic acids; antioxidants including ascorbic acid; low molecular weight (less than about 10 residues) polypeptide; proteins, such as serum albumin, gelatin, or immunoglobulins; hydrophilic polymers such as polyvinylpyrrolidone; amino acids such as glycine, glutamine, asparagine, arginine or lysine; monosaccharides, disaccharides, and other carbohydrates including glucose, mannose, or dextrins; chelating agents such as EDTA; sugar alcohols such as mannitol or sorbitol; salt-forming counterions such as sodium; and/or nonionic surfactants.

As used herein, the term "hydrophilic" refers to polymers, materials, or functional groups having an affinity for water and tending to mix with, dissolve in, or be wetted by water. A hydrophilic molecule or portion thereof, for example, is one whose interactions with water and other polar substances are more thermodynamically favorable than their interactions with oil or other hydrophobic solvents. Such materials typically include one or more hydrophilic functional groups, such as hydroxyl, zwitterionic, carboxy, amino, amide, phosphate, hydrogen bond forming, and/or ether groups. Generally, hydrophilic molecules (and portions of molecules) can be contrasted with hydrophobic molecules (and portions of molecules). In some cases, both hydrophilic and hydrophobic properties occur in a single molecule. An example of these amphiphilic molecules is the lipids that comprise the cell membrane. Another example is soap, which has a hydrophilic head and a hydrophobic tail, allowing it to dissolve in both water and oil. Hydrophilic and hydrophobic molecules are also known as polar molecules and nonpolar molecules, respectively. Some hydrophilic substances do not dissolve. This type of mixture is called a colloid.

As used herein, a "hydrophilic fill material" or "hydrophilic fill" refers to the any material used to fill a softgel, the material being hydrophilic, either alone or in combination with other materials that are used to fill the softgel. Similarly, a "hydrophilic softgel" as used herein refers to a softgel that includes a hydrophilic fill material. An example hydrophilic fill material is polyethylene glycol or a derivative thereof, as described further herein.

In certain example embodiments, the hydrophilic fill material described herein are anhydrous and compatible with soft gelatin capsules. Non-limiting exemplary vehicles comprise CAPMUL® MCM, CAPTEX® 355, CREMOPHOR® RH 40, Croscarmellose, Crospovidone, Crospovidone CL, Crospovidone CL-F, Crospovidone CL-M, IMWITOR® 742, KOLLIDON® CL, KOLLIDON® CL-F, KOLLIDON® CL-M, LABRAFAC™ Lipophile WL 1349, LABRAFIL® M2125CS, LABRASOL®, LUTROL® F 68, MAISINE™ 35-1, mannitol, MIGLYOL® 812, PEARLITOL® Flash, PECEOL®, PLURAL® Oleique CC 497, Povidone K 17, or Povidone K 30.

In certain example embodiments, the hydrophilic fill may include one or more disintegrant excipients. Disintegrants include any polymer, which expands in aqueous solution causing a tablet or capsule to burst and facilitate dissolution. Exemplary, non-limiting disintegrants comprise crosslinked polyvinylpyrrolidone (e.g., crospovidone), crosslinked sodium carboxymethyl cellulose (croscarmellose sodium) carboxymethyl cellulose calcium, cysteine HCl, modified starches (e.g., sodium starch glycolate), cellulose, calcium silicate, silicon dioxide, alginic acid, sodium alginate, citric acid, microcrystalline cellulose, polyoxy stearate, sodium carmellose, sodium lauryl sulfate, or a mixture or combination thereof.

In certain example embodiments, the hydrophilic fill material may include one or more surfactants. The surfactant can have a hydrophilic/lipophilic balance (HLB) value between about 1 and about 25 and a melting point between about 25° C. and about 70° C. The HLB characteristic of surfactants can be determined in accordance with "Physical Pharmacy: Physical Chemical Principles in the Pharmaceutical Sciences," Fourth Edition, pp. 371-373, A. Martin, Ed., Lippincott Williams & Wilkins, Philadelphia (1993). Suitable, non-limiting surfactants include: glyceryl monocaprylate (e.g., CAPMUL® MCM), PLURONIC® 10R5, PLURONIC® 17R2, PLURONIC® 17R4, PLURONIC® 25R2, PLURONIC® 25R4, PLURONIC® 31R1, PLURONIC® F. 108, PLURONIC® F. 108 NF, PLURONIC® F. 108, PLURONIC® F. 108NF, Poloxamer 338, PLURONIC® F. 127, PLURONIC® F. 127 NF, PLURONIC® F. 127 NF 500 BHT Prill, PLURONIC® F. 127 NF Prill, Poloxamer 407, PLURONIC® F. 38, PLURONIC® F. 38 Pastille, PLURONIC® F. 68, PLURONIC® F. 68 LF Pastille, PLURONIC® F. 68 NF, PLURONIC® F. 68 NF Prill, Poloxamer 188, PLURONIC® F. 68 Pastille, PLURONIC® F. 77, PLURONIC® F. 77 Micropastille, PLURONIC® F. 87, PLURONIC® F. 87 NF, PLURONIC® F. 87 NF Prill, Poloxamer 237, PLURONIC® F. 88, PLURONIC® F. 88 Pastille, PLURONIC® F. 98, PLURONIC® L 10, PLURONIC® L 101, PLURONIC® L 121, PLURONIC® L 31, PLURONIC® L 35, PLURONIC® L 43, PLURONIC® L 61, PLURONIC® L 62, PLURONIC® L 62 LF, PLURONIC® L 62D, PLURONIC® L 64, PLURONIC® L 81, PLURONIC® L 92, PLURONIC® N 3, PLURONIC® P 103, PLURONIC® P 104, PLURONIC® P 105, PLURONIC® P 123 Surfactant, PLURONIC® P 65, PLURONIC® P 84, PLURONIC® P 85, ADOGEN® 464, ALKANOL® 6112, BRIJ® 52, BRIJ® 93, BRIJ® S2, BRIJ® S, BRIJ® 58, BRIJ® C10, BRIJ® L4, BRIJ® 010, BRIJ® 010, BRIJ® 020, BRIJ® S10, BRIJ® S20, ethylenediamine tetrakis(ethoxylate-block-propoxylate) tetrol, ethylenediamine tetrakis(ethoxylate-block-propoxylate) tetrol, ethylenediamine tetrakis (propoxylate-block-ethoxylate) tetrol, IGEPAL® CA-210, IGEPAL® CA-520, IGEPAL® CA-720, IGEPAL® CO-520, IGEPAL® CO-630, IGEPAL® CO-720, IGEPAL® CO-890, IGEPAL® DM-970, MERPOL® DA, MERPOL® HCS, MERPOL® OJ, MERPOL® SE, MERPOL® SH, MERPOL® A, Poly(ethylene glycol) sorbitan tetraoleate, poly(ethylene glycol) sorbitol hexaoleate, poly (ethylene glycol) (12), poly(ethylene glycol) (18), polyethylene-block-poly(ethylene glycol), sorbitan monopalmitate, 2,4,7,9-tetramethyl-5-decyne-4,7-diol ethoxylate, NONIDET™ P-40, TRITON™ N-101, TRITON™ X-100, TRITON™ X-114, TRITON™ X-405, TWEEN® 20, TWEEN® 40, TWEEN® 60, TWEEN® 85, ZONYL® FS-300, or ZONYL® FSN or a mixture or combination thereof.

In certain example embodiments, the hydrophilic fill material may include a hygroscopic polymer. For example, the hygroscopic polymers can include polyvinylpyrrolidone, copovidone, hydroxypropylmethyl-cellulose, hydroxypropyl-cellulose, ethyl cellulose, methylcellulose, and polyethylene oxide. Suitable hygroscopic polymers include polyvinyl alcohol, a copolymer of polyvinylpyrrolidone and polyvinyl acetate, hydroxypropyl cellulose, hydroxypropyl methylcellulose, hydroxyethyl cellulose, hydroxymethyl cellulose, gelatin, polyethylene oxide, such as POLYOX™ 100,000-600,000 MW, acacia, dextrin, starch, polyhydroxyethylmethacrylate, a water-soluble non-ionic polymethacrylate or copolymer thereof, a modified cellulose, a modified polysaccharide, a non-ionic gum, or a non-ionic polysaccharide.

In certain example embodiments, the hydrophilic fill material may include one or more lipids or lipophilic vehicles. In one aspect, the lipid or lipophilic vehicle may be a liquid or a solid or a semisolid lipid or lipophilic vehicle. Suitable non-limiting liquid lipid or lipophilic vehicles comprise olive oil, soybean oil, cannabinoid oil, sunflower oil, canola oil, omega fatty acids (such as an omega-3 or omega-7 fatty acid), palmitoleic acid, oleic acid, myristoleic acid, linoleic acid, arachidonic acid, paraffin oil, or mineral oil or a mixture or combination thereof. The lipid or lipophilic vehicle can be a semi-solid lipophilic vehicle such as a polyethylene glycol glyceride ester, e.g., GELUCIRE® 33/01, GELUCIRE® 37/02, GELUCIRE® 39/01, GELUCIRE® 43/01, GELUCIRE® 44/14, GELUCIRE® 50/02, GELUCIRE® 50/13, GELUCIRE® 53/10, or GELUCIRE® 62/02; a paraffin wax, carnauba wax, or bee's wax.

In certain example embodiments, the hydrophilic fill material may include one or more pH modifying agents or neutralizing agents. Suitable non-limiting examples of such agents include acetic acid, ammonium carbonate, ammonium phosphate, boric acid, carbonic acid, citric acid, dibasic sodium phosphate, diluted hydrochloric acid, diluted phosphoric acid, fumaric acid, glacial acetic acid, hydrochloric acid, lactic acid, malic acid, monobasic sodium phosphate, nitric acid, phosphoric acid, potassium citrate, potassium metaphosphate, potassium phosphate monobasic, sodium acetate, sodium citrate, sodium lactate solution, sulfuric acid, tartaric acid, sodium hydroxide, ammonium hydroxide, potassium hydroxide, sodium bicarbonate, sodium carbonate, or a mixture or combination thereof.

Additional pharmaceutical excipients useful for the pharmaceutical composition described herein include, for example, the following: Alkalizing agents (ammonia solution, ammonium carbonate, diethanolamine, diisopropanolamine, potassium hydroxide, sodium bicarbonate, sodium borate, sodium carbonate, sodium hydroxide, trolamine); Antifoaming agents (dimethicone, simethicone); Antimicrobial preservatives (benzalkonium chloride, benzalkonium chloride solution, benzethonium chloride, benzoic acid, benzyl alcohol, butylparaben, cetylpyridinium chloride, chlorobutanol, chlorocresol, cresol, dehydroacetic acid, ethylparaben, methylparaben, methylparaben sodium, phenol, phenylethyl alcohol, phenylmercuric acetate, phenylmercuric nitrate, potassium benzoate, potassium sorbate, propylparaben, propylparaben sodium, sodium benzoate, sodium dehydroacetate, sodium propionate, sorbic acid, thimerosal, thymol); Antioxidants (ascorbic acid, ascorbyl palmitate, butylated hydroxyanisole, butylated hydroxytoluene, hypophosphorous acid, monothioglycerol, propyl gallate, sodium formaldehyde sulfoxylate, sodium metabisulfite, sodium thiosulfate, sulfur dioxide, tocopherol, tocopherols excipient); Chelating agents (edetate disodium, ethylenediaminetetraacetic acid and salts, edetic acid); Coating agents (sodium carboxymethylcellulose, cellulose acetate, cellulose acetate phthalate, ethylcellulose, gelatin, pharmaceutical glaze, hydroxypropyl cellulose, hydroxypropyl methylcellulose, hydroxypropyl methylcellulose phthalate, methacrylic acid copolymer, methylcellulose, polyvinyl acetate phthalate, shellac, sucrose, titanium dioxide, carnauba wax, microcrystalline wax, zein); Colorants (caramel, red, yellow, black or blends, ferric oxide); Complexing agents (ethylenediaminetetraacetic acid and salts (EDTA), edetic acid, gentisic acid ethanolamide, oxyquinoline sulfate); Desiccants (calcium chloride, calcium sulfate, silicon dioxide); a Wetting agent, such as lecithin; Emulsifying and/or solubilizing agents (acacia, cholesterol, diethanolamine (adjunct), glyceryl monostearate, lanolin alcohols, mono- and di-glycerides, monoethanolamine (adjunct), oleic acid (adjunct), oleyl alcohol (stabilizer), poloxamer, polyoxyethylene 50 stearate, polyoxyl 35 castor oil, polyoxyl 40 hydrogenated castor oil, polyoxyl 10 oleyl ether, polyoxyl 20 cetostearyl ether, polyoxyl 40 stearate, polysorbate 20, polysorbate 40, polysorbate 60, polysorbate 80, diacetate, monostearate, sodium lauryl sulfate, sodium stearate, sorbitan monolaurate, sorbitan monooleate, sorbitan monopalmitate, sorbitan monostearate, stearic acid, trolamine, emulsifying wax); Filtering aids (powdered cellulose, purified siliceous earth); Flavors and perfumes (anethole, benzaldehyde, ethyl vanillin, menthol, methyl salicylate, monosodium glutamate, orange flower oil, peppermint, peppermint oil, peppermint spirit, rose oil, stronger rose water, thymol, tolu balsam tincture, vanilla, vanilla tincture, vanillin); Humectants (glycerin, hexylene glycol, sorbitol); Plasticizers (e.g., castor oil, diacetylated monoglycerides, diethyl phthalate, glycerin, mono- and di-acetylated monoglycerides, propylene glycol, triacetin, triethyl citrate); polymers (e.g., cellulose acetate, alkyl celluloses, hydroxyalkyl, acrylic polymers and copolymers); Solvents (acetone, alcohol, diluted alcohol, amylene hydrate, benzyl benzoate, butyl alcohol, carbon tetrachloride, chloroform, corn oil, cottonseed oil, ethyl acetate, glycerin, hexylene glycol, isopropyl alcohol, methyl alcohol, methylene chloride, methyl isobutyl ketone, mineral oil, peanut oil, propylene carbonate, sesame oil, water for injection, sterile water for injection, sterile water for irrigation, purified water); Sorbents (powdered cellulose, charcoal, purified siliceous earth); Carbon dioxide sorbents (barium hydroxide lime, soda lime); Stiffening agents (hydrogenated castor oil, cetostearyl alcohol, cetyl alcohol, cetyl esters wax, hard fat, paraffin, polyethylene excipient, stearyl alcohol, emulsifying wax, white wax, yellow wax); Suspending and/or viscosity-increasing agents (acacia, agar, alginic acid, aluminum monostearate, bentonite, purified bentonite, magma bentonite, carbomer, carboxymethylcellulose calcium, carboxymethylcellulose sodium, carboxymethylcellulose sodium 12, carrageenan, microcrystalline and carboxymethylcellulose sodium cellulose, dextrin, gelatin, guar gum, hydroxyethyl cellulose, hydroxypropyl cellulose, hydroxypropyl methylcellulose, magnesium aluminum silicate, methylcellulose, pectin, polyethylene oxide, polyvinyl alcohol, povidone, alginate, silicon dioxide, colloidal silicon dioxide, sodium alginate, tragacanth, xanthan gum); Sweetening agents (aspartame, dextrates, dextrose, excipient dextrose, fructose, mannitol, saccharin, calcium saccharin, sodium saccharin, sorbitol, solution sorbitol, sucrose, compressible sugar, confectioner's sugar, syrup); binders (acacia, alginic acid, sodium carboxymethylcellulose, microcrystalline cellulose, dextrin, ethylcellulose, gelatin, liquid glucose, guar gum, hydroxypropyl methylcellulose, methylcellulose, polyethylene oxide, povidone, pregelatinized starch, syrup); capsule diluents (calcium carbonate, dibasic calcium phosphate, tribasic calcium phosphate, calcium sulfate, microcrystalline cellulose, powdered cellulose, dextrates, dextrin, dextrose excipient, fructose, kaolin, lactose, mannitol, sorbitol, starch, pregelatinized starch, sucrose, compressible sugar, confectioner's sugar); capsule lubricants (calcium stearate, glyceryl behenate, magnesium stearate, light mineral oil, sodium stearyl fumarate, stearic acid, purified stearic acid, talc, hydrogenated vegetable oil, zinc stearate); Tonicity agent (dextrose, glycerin, mannitol, potassium chloride, sodium chloride); Vehicle: flavored and/or sweetened (aromatic elixir, compound benzaldehyde elixir, iso-alcoholic elixir, peppermint water, sorbitol solution, syrup, tolu balsam syrup); Vehicle: oleaginous (almond oil, corn oil, cottonseed oil, ethyl oleate, isopropyl myristate, isopropyl palmitate, mineral oil, light mineral oil, myristyl alcohol, octyl dodecanol, olive oil, peanut oil, persic oil, sesame oil, soybean oil, squalane); Vehicle: solid carrier (sugar spheres); Vehicle: sterile (Bacteriostatic water for injection, bacteriostatic sodium chloride injection); Viscosity-increasing (see suspending agent); Water repelling agent (cyclomethicone, dimethicone, simethicone); and/or solubilizing agent (benzalkonium chloride, benzethonium chloride, cetylpyridinium chloride, docusate sodium, nonoxynol 9, nonoxynol 10, octoxynol 9, poloxamer, polyoxyl 35 castor oil, polyoxyl 40, hydrogenated castor oil, polyoxyl 50 stearate, polyoxyl 10 oleyl ether, polyoxyl 20, cetostearyl ether, polyoxyl 40 stearate, polysorbate 20, polysorbate 40, polysorbate 60, polysorbate 80, sodium lauryl sulfate, sorbitan monolaurate, sorbitan monooleate, sorbitan monopalmitate, sorbitan monostearate, tyloxapol). This non-limiting list is merely representative of the classes of excipients and the particular excipients that may be used in the pharmaceutical compositions as described herein.

Suitable hydrophilic fills for solubilizing active pharmaceutical ingredients are described in International Patent Application Publication No. WO 2006/096580, U.S. Patent Application Publication No. US 2007/0053868, and U.S. Pat. No. 8,333,989, each of which is incorporated by reference herein for such teachings in its entirety.

In certain example embodiments, the hydrophilic fill is a polyethylene glycol (PEG) or derivative thereof, such polyethylene glycol 200, polyethylene glycol 400, polyethylene glycol 600, polyethylene glycol 800, polyethylene glycol 1000, polyethylene glycol 2000, polyethylene glycol 3350, propylene glycol, glycerol, or mixtures thereof. In on embodiment the hydrophilic fill comprises one or more hydro-alcohols including polyethylene glycols of a molecular weight ranging from about 200 to about 8000 or a mixture or combination thereof.

As those of skill in the art will appreciate, polyethylene glycol has the general formula:

$$HO(CH_2CH_2O)_nH$$

wherein n is from 4 to 18. Non-limiting examples include PEG 400 [n=8-9] having an average molecular weight of from 380-420 available ex Acme-Hardesty and PEG 600 [n=12-14] having an average molecular weight of from 570-630 available ex Sigma-Aldrich. The formulator can also select polyethylene glycols having a broader range of ethyleneoxy units. For Example, a PEG 400 with a range of n=7-10. Other suitable polyethylene glycols include PEG 200, PEG 250, PEG 300, PEG 350, PEG 450, PEG 500, PEG 550, PEG 650, PEG 700, and PEG 750.

In another example embodiment, the disclosed hydrophilic fill is polyoxyethylene glycol alkyl ethers having the formula:

$$RO(CH_2CH(CH_3)O)_nH$$

wherein R is a linear or branched alkyl group having from 1 to 20 carbon atoms and n is 2 to 20.

In another example embodiment, the disclosed hydrophilic fill is polyoxyethylene polyoxypropylene block copolymers known as "poloxamers" having the formula:

$$HO(CH_2CH_2)_{y1}(CH_2CH_2CH_2O)_{y2}(CH_2CH_2O)_{y3}OH,$$

which are nonionic block copolymers composed of a polypropyleneoxy unit flanked by two polyethyleneoxy units. The indices $y^1$, $y^2$, and $y^3$ have values such that the poloxamer has an average molecular weight of from about 500 g/mol to about 20,000 g/mol. These fills are also well known by the trade name PLURONICS™. These compounds are commonly named with the word Poloxamer followed by a number to indicate the specific co-polymer, for example Poloxamer 407 having two PEG blocks of about 101 units ($y^1$ and $y^3$ each equal to 101) and a polypropylene block of about 56 units. This category of hydrophilic fill is commercially available, for example, under the trade name LUTROL™ F-17 available from BASF.

As used herein, a "softgel" refers to a soft dosage form, such as a gelatin-based capsule, that is provided as a single dosage form. In certain example embodiments, the softgel includes a liquid fill, such as a suspension, semisolid, or matrix, which is enveloped by two halves of a gelatin shell to form a single, hermetically sealed dosage form. As one skilled in the art will appreciate, the gelatin shell can be composed of gelatin, a plasticizer, and water, and can also include other ingredients such as preservatives, coloring, flavorings, opacifying agents, sweetening agents, acids, salts, medicaments, or other agents to achieve a desired dosage effect. Plasticizers that are useful for creating soft capsules as described herein are glycerol, sorbitol, polyethylene glycols, or combinations thereof.

As used herein, a "subject" refers to an animal, including a vertebrate animal. The vertebrate can be a mammal, for example, a human. In certain examples, the subject can be a human patient. A subject can be a "patient," for example, such as a patient suffering from or suspected of suffering from a disease or condition and can be in need of treatment or diagnosis or can be in need of monitoring for the progression of the disease or condition. The patient can also be in on a treatment therapy that needs to be monitored for efficacy. A mammal refers to any animal classified as a mammal, including, for example, humans, chimpanzees, domestic and farm animals, as well as zoo, sports, or pet animals, such as dogs, cats, cattle, rabbits, horses, sheep, pigs, and so on.

EXAMPLE EMBODIMENTS

Provided herein are methods and systems for drying (curing) softgels having a hydrophilic fill material, the hydrophilic fill material also including one or more active ingredients as described herein. That is, the softgel includes a fill material that is hydrophilic, the active ingredient being suspended within, dissolved in, mixed with, or otherwise associated with or combined with the hydrophilic fill material. And, as those skilled in the art will appreciate, the hydrophilic fill material can also include on or more carriers and/or excipients as described herein.

With reference to the drawings, FIGS. 1-8 show block diagrams for a softgel drying system that can be used in accordance with the drying methods described herein. This system is described in U.S. Pat. No. 8,621,764, titled "Gelatin capsule formulation and drying system," which is hereby expressly incorporated herein in its entirety. It should be understood that the processes described and shown herein are described as performed within a manufacturing warehouse/building. This is done for illustrative purposes only and for ease of understanding and is not considered limiting in any way.

With reference to FIG. 1, the building includes an area for fill tanks 10, a gel prep area 12 and a gel receiver area 14. These areas can be within the same room or in separate rooms. The building also includes three separate zones/rooms in which the drying process occurs (described below). Each zone is also supplied with sensors for monitoring temperature and humidity, among other conditions. The system includes a dehumidifier/HVAC unit 20, chiller 24, control panels for controlling the conditions of each of the zones, ducting, water lines, electrical schematics, and three air handler units 22. Each air handler unit 22 is capable of cooling and heating within each zone.

Generally, the softgels are manufactured according to the following process. First, raw materials are transferred from bulk storage to the fill tanks 10 where the product is agitated continuously. In the gel prep area 12, raw gelatin is placed in a gel prep tank/reactor and is liquefied. Then, the gelatin is aged in the gel receiver area 14. The fill, in this case a hydrophilic fill material, is encapsulated in a capsule injector 16, thereby forming a softgel. The softgels are cured as they are processed through a series of tumble dryers 18 based on the parameters described herein. In certain example embodiments, a sorter 19 sorts and removes defective softgels. In certain example embodiments, the hydrophilic softgels can be dried to a hardness of eight newtons in less than about 24 hours, such as in about 24, 23, 22, 21, 20, 19, 18, 17, 16, 15, 14, or 13 hours.

The softgels are generally prepared by encapsulating a hydrophilic fill in a gelatin shell. The shells and fills are prepared according to formulations well known to those of skill in the art. Accordingly, the system and process set forth above can be used for drying any softgel having a hydrophilic fill. However, in certain example embodiments, the system is used to dry softgels having a desired formula and steps for preparation. An exemplary batch for the preferred gelatin formulation is 219.0 kg of gelatin 150 bloom, 60 kg of glycerin 99.5%, 50 kg and 172.5 kg of purified water and 6.5 kg of caramel color. In certain examples embodiments, the softgels include between about 37% and about 41% 150 bloom bovine gelatin, between about 7% and about 15% glycerine, between about 5% and about 15% sorbitol, and between about 25% and about 29% water.

In certain example embodiments, the process for making the softgel shell includes the following steps: Pre-weigh all raw materials into clean containers. Add glycerin and purified water to the gelatin melter (which is set in an exemplary embodiment to 176° F.). Turn on the mixer and leave mixing. Once the mixer reaches about 176° F. add the pre-weighed raw gelatin. Apply vacuum to allow the liquids to rise and saturate the gelatin. Turn off the vacuum, but leave the tank sealed with the vacuum. Leave on the mixer/agitator and allow the gelatin to mix for 30 minutes. Deaerate the gelatin. Leave the vacuum valve on the gelatin melter closed to seal the vacuum and turn off the vacuum pump. Allow the gelatin to mix under sealed vacuum for 10 minutes at slow mixing speed, or until the temperature is between about 149° F. to about 158° F. The filled hydrophilic softgel, prior to drying/curing, has an "original water content."

The process of curing the softgels will now be described in more detail. During the curing process, the softgels sequentially pass through the series of tumble dryers 18 (also referred to herein as a tumble drying line 18) that reside in and span three separate air conditioning zones or rooms (labeled zone 1, zone 2 and zone 3 in the figures). Hence, the softgels sequentially pass through the series of drying zones in order to cure the softgels. It will be appreciated that there could be as few as three tumble dryers; one in each zone. In a preferred embodiment, the zones are separate rooms that are separated by walls or other partitions. However, in another example embodiment, the zones can be all located within the same room or space.

In certain example embodiments, each zone is maintained at a predetermined temperature, relative humidity, and dew point condition for drying softgels having a hydrophilic fill. Example equipment for maintaining the zones at the desired temperature and humidity and providing the desired air flow within each zone is described herein.

To dry a softgel having a hydrophilic fill, a lower temperature and dewpoint is needed, as compared to drying a conventional softgel (such as a softgel having a hydrophobic fill material). For example, to dry the hydrophilic softgel, the temperature in zone 1 can be between about 35° F. and 45° F., such as about 35° F., 37° F., 38° F., 39° F., 40° F., 41° F., 42° F., 43° F., 44° F., or 45° F. In such example embodiments, the relative humidity in zone 1 can be between about 15% and 22%. For example, the relative humidity can be about 15, 16, 17, 18, 19, 20, 21, or 22%. While such temperatures and relative humidity values can produce a variety of dewpoints, the dew point of zone 1 is kept between 0° F. and 8° F., such as about 0, 1, 2, 3, 4, 5, 6, 7, or about 8° F. In certain examples embodiments, in zone 1 the temperature is about 40° F., the relative humidity is about 18-20%, with a dew point of about 0-4° F. In certain example embodiments, the temperature may even be lower, such as about 30° F., 31° F., 32° F., 33° F., or 34° F.

Regarding zone 2, to dry a softgel having a hydrophilic fill, a lower temperature is again needed, as compared to drying a conventional softgel (such as a softgel having a hydrophobic fill material). For example, the temperature in zone 2 can be between about 60° F. and 67° F., such as about 60, 61, 62, 63, 64, 65, 66, or 67° F. In such example embodiments, the relative humidity in zone 1 can be between about 9% and 15%. For example, the relative humidity can be about 9, 10, 11, 12, 13, 14, or 15%. While such temperatures and relative humidity values can produce a variety of dewpoints, the dew point of zone 2 is kept between 0° F. and 16° F., such about 0, 1, 2, 3, 4, 5, 6, 7, 8, 9, 10, 11, 12, 13, 14, 15, or about 16° F. In certain examples embodiments, in zone 2 the temperature is about 64° F., the relative humidity is about 10%, with a dew point of about 6° F.

In certain example embodiments, the temperature of zone 3 can be between about 68° F. and 74° F., such as about 68, 69, 70, 71, 72, 73, or 74° F. In such example embodiments, the relative humidity in zone 3 can be between about 10% and 15%. For example, the relative humidity can be about 10, 11, 12, 13, 14, or 15%. While such temperatures and relative humidity values can produce a variety of dewpoints, the dew point of zone 3 is kept between about 10° F. and 23° F., such as about 10, 11, 12, 13, 14, 15, 16, 17, 18, 19, 20, 21, 22, or 23° F. In certain examples embodiments, in zone 3 the temperature can be about 70° F., the relative humidity can be about 10%, with a dew point of about 11° F.

To dry the softgels including a hydrophilic fill, the total drying time as the softgels sequentially pass through zones 1, 2, and 3 can be less than about 30 hours, such as about 29, 28, 27, 26, 25, 24, 23, 22, 21, 20, 19, 18, 17, 16, 15, 14, 13, 12, 11, or 10 hours of total drying time. In certain example embodiments, the total drying time is about 13, 14, 15, 16, or 17 hours. In certain example embodiments, the hydrophilic softgels remain in zone 1 for about 2 hours and then pass to zone 2 where they remain for about 8, 9, 10, 11, or 12 hours before passing to zone 3. Once in zone 3, the hydrophilic softgels remain in zone 3 for about 3 hours. Hence, in such example embodiments, the hydrophilic softgels have a total drying time of about 13 hours to about 17 hours, such as about 15 hours. In certain example embodiments, the total drying time is about 13, 14, 15, 16, or 17 hours.

The temperature, humidity and dew point conditions set forth above can be provided by an HVAC unit 20 together with an air handler unit 22 within each zone. As can be seen in FIG. 1, in certain example embodiments the HVAC unit 20, provides conditioned air to the air handler unit 22 within each zone. The air is conditioned by the air handler unit 22 after it leaves the HVAC unit 20 and prior to entering each zone/room atmosphere. Within each zone, the resident air handler unit 22 is capable of adjusting the temperature, dew point, and humidity of the air prior to its release into the air/room atmosphere.

It will be appreciated by those skilled in the art that the air handler units 22 blow the conditioned air over the softgels as they move through the tumbler drying line 18. Cubic feet per minute (CFM) is a standard measurement of airflow indicating how many cubic feet of air pass a point in one minute. In certain example embodiments, the zone 1 air handler unit 22 outputs air at between about 4000 CFM and about 7000 CFM, such as about 4000, 4500, 5000, 5500, 6000, 6500, or 7000 CFM. In certain example embodiments, the zone 2 air handler unit 22 outputs air at between about 4000 CFM and about 7000 CFM, such as about 4000, 4500, 5000, 5500, 6000, 6500, or 7000 CFM. In certain example embodiments, the zone 3 air handler unit 22 outputs air at between about 1000 CFM and about 3000 CFM, such as about 1000, 1500, 2000, 2500, or 3000 CFM.

Without wishing to be bound by any particular theory, it is believed that the conditions of zone 1 allow more water to be removed from the softgel shell of a hydrophilic softgels as compared to a conventional softgel. For example, it is believed that, unlike a conventional softgel where only a minimal amount of water would be removed from the shell in zone 1, the conditions of zone 1 described herein remove about 20-40% of the water out of the shell, such as about 30% of the water out of the softgel shell and into the surrounding environment. This is believed to allow water to begin to migrate slowly from the hydrophilic fill material and into the softgel shell of the hydrophilic softgel. This migration is believed to continue in zone 2, where as much as about 15-25% of the water (based on the original water content) from the hydrophilic fill material is believed to migrate from the hydrophilic fill material and into the shell. For example, in zone 2 about 20% of the water in the hydrophilic fill material is believed to migrate into the shell. Thereafter, in zone 3, it is believed that the water that has migrated from the hydrophilic fill material to the softgel shell in zone 2 is removed from the softgel shell. For example, an additional 15-25% of water (based on the original water content), such as about 20% of water, is removed from the softgel shell in zone 3, and the hydrophilic softgel shell and filling is believed to reach a migration equilibrium. It is also believed that including sorbitol at about 5-15%, such as about 5%, 6%, 7%, 8%, 9%, 10%, 11%, 12%, 13%, 14% or 15% in the shell of the hydrophilic softgel facilitates the drying process described herein. By drying the softgel with a hydrophilic fill as describe here, a softgel can be obtained that is normal in appearance and that has improved structural integrity. The drying time can also be beneficially reduced as compared to conventional drying times of hydrophilic softgels, as described in further detail herein.

Figure 3:
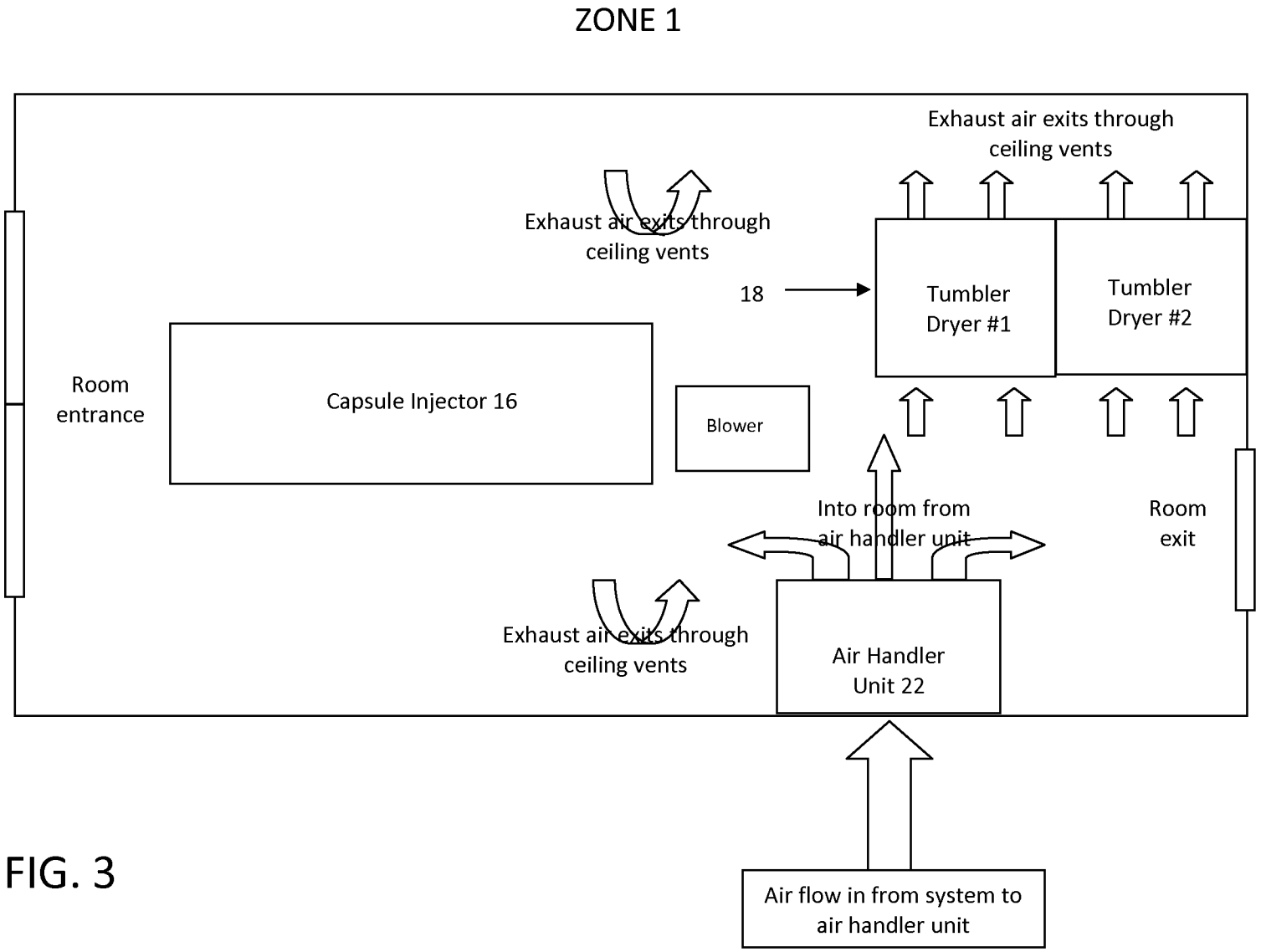
FIG. 3 is a schematic of zone 1 of the drying system of FIG. 1, in accordance with certain example embodiments.
Figure 5:
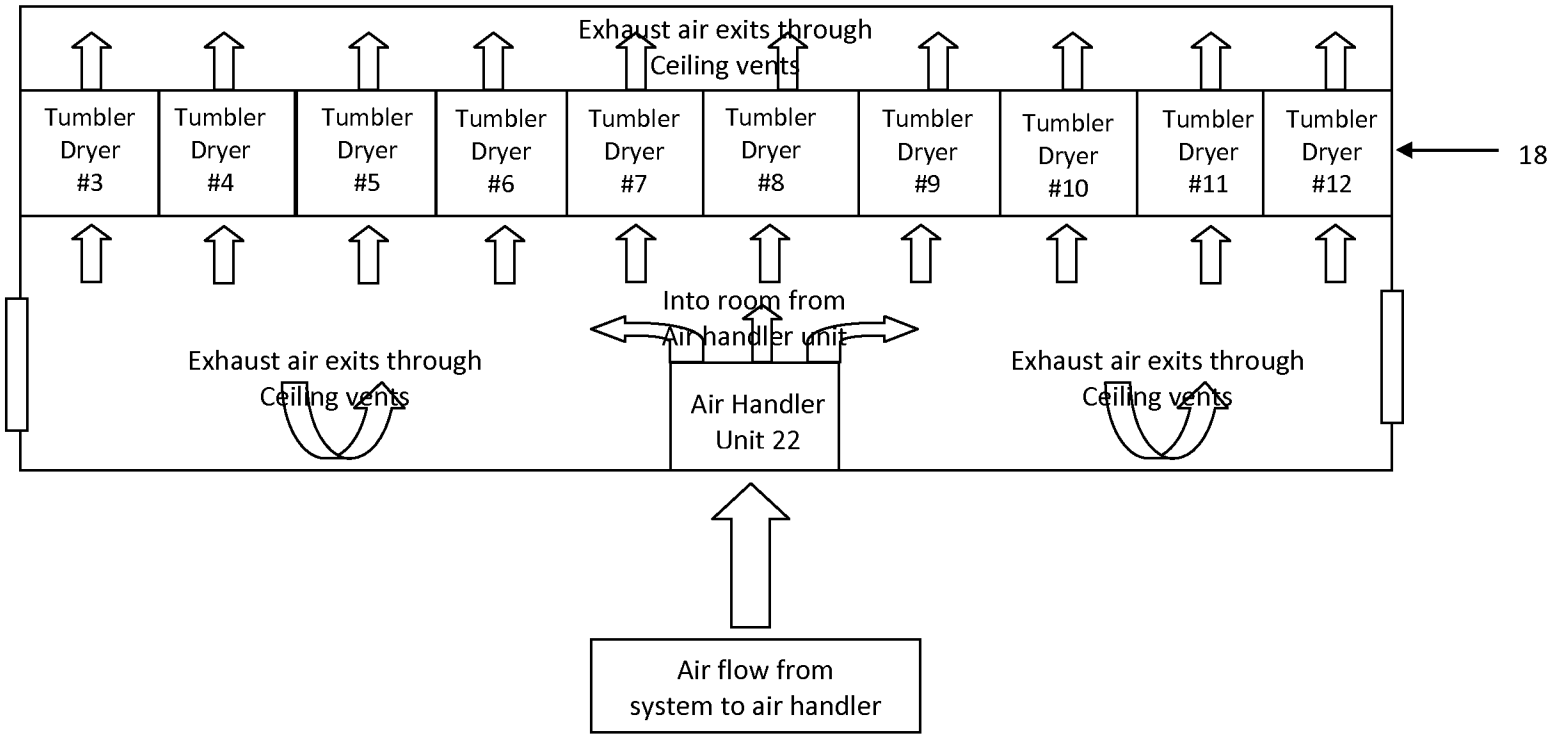
FIG. 5 is a schematic of zone 2 of the drying system of FIG. 1, in accordance with certain example embodiments.
Figure 7:
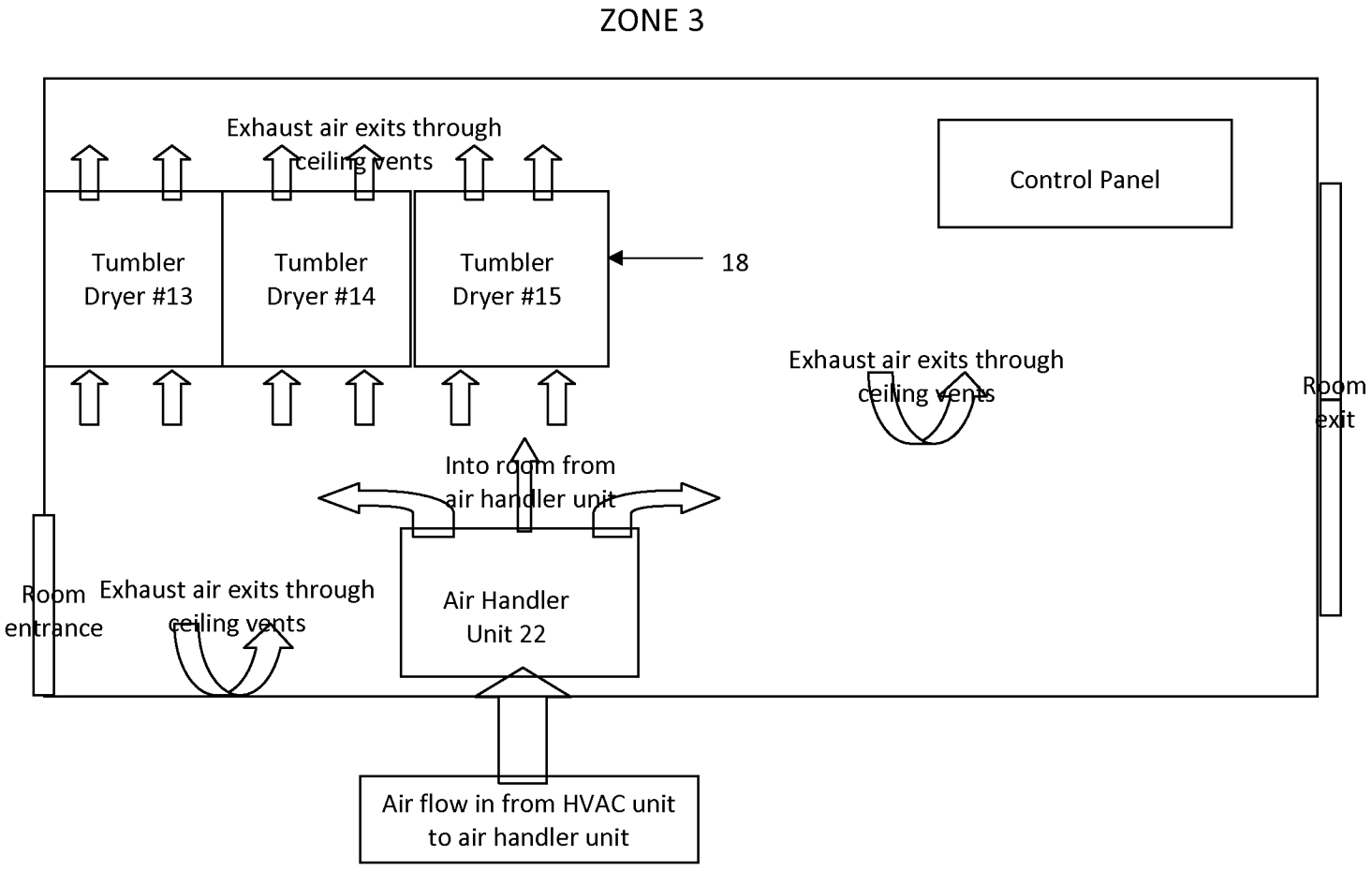
FIG. 7 is a schematic of zone 3 of the drying system of FIG. 1, in accordance with certain example embodiments.

FIGS. 3, 5, and 7 show the location of the air handler units 22, tumble drying line 18 and other components within each zone. The components shown in these figures are generally positioned or mounted on the floor of the zone. In certain example embodiments, the system includes two tumble dryers in zone 1, ten tumble dryers in zone 2 and three tumble dryers in zone 3, for a total of fifteen tumble dryers. However, it will be appreciated by those skilled in the art that any number of tumble dryers can be located within each zone. It will be understood that as the softgels pass through the various tumble dryers 18, air from the air handler unit 22 within the zone is blown over the softgels.

Figure 4:
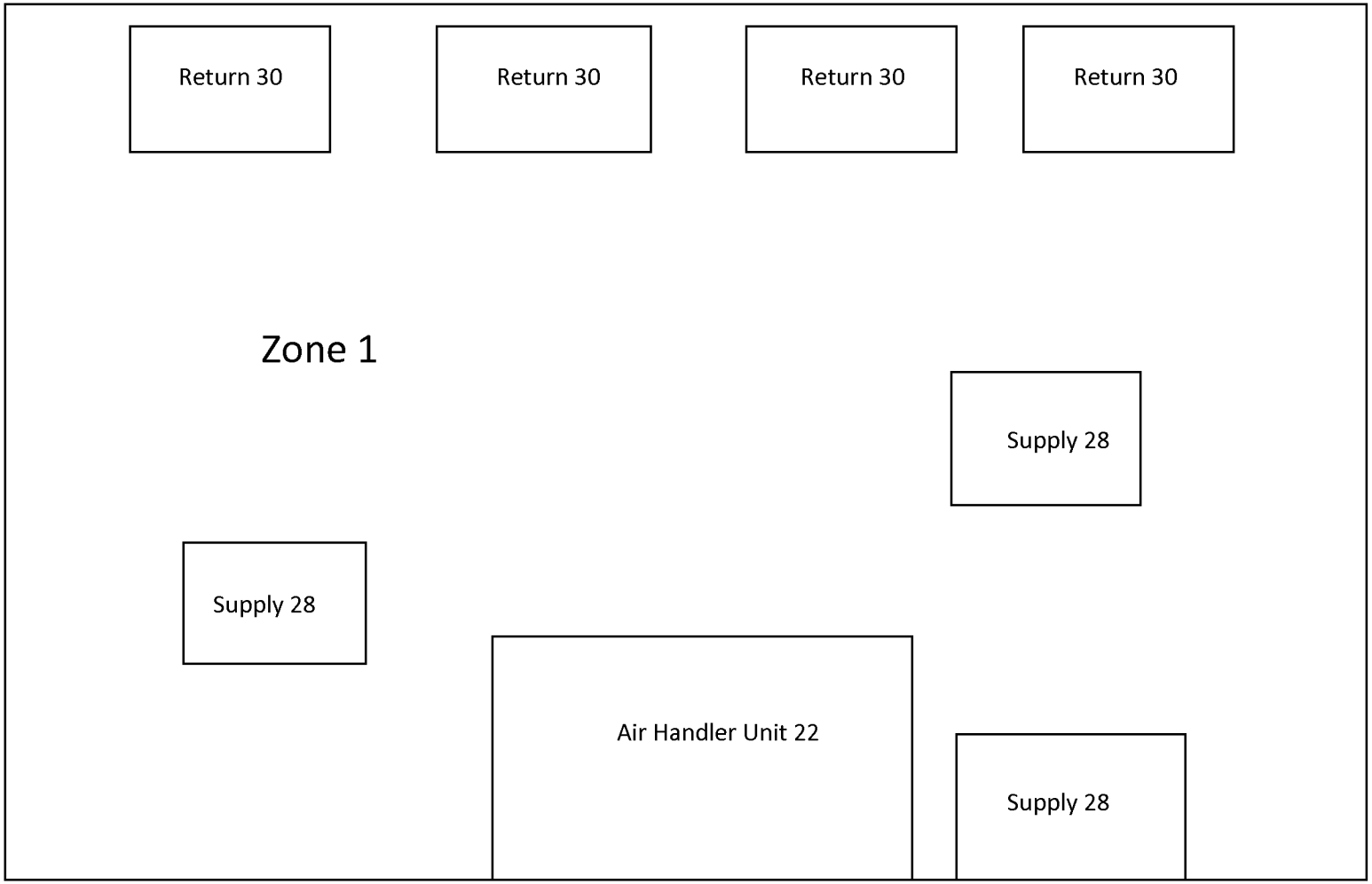
FIG. 4 is a schematic of the ducting system of zone 1 of the drying system of FIG. 1, in accordance with certain example embodiments.
Figure 6:
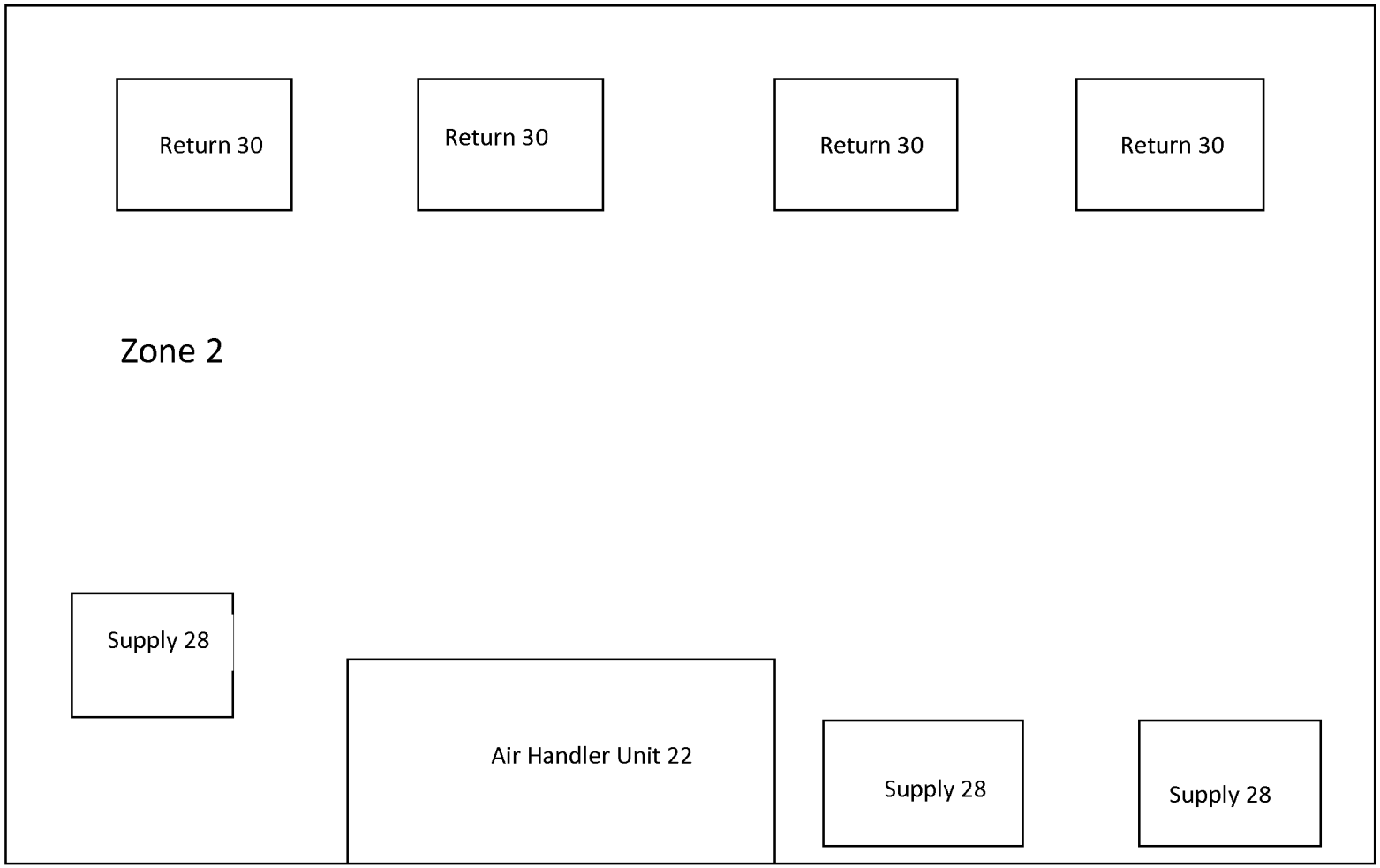
FIG. 6 is a schematic of the ducting system of zone 2 of the drying system of FIG. 1, in accordance with certain example embodiments.
Figure 8:
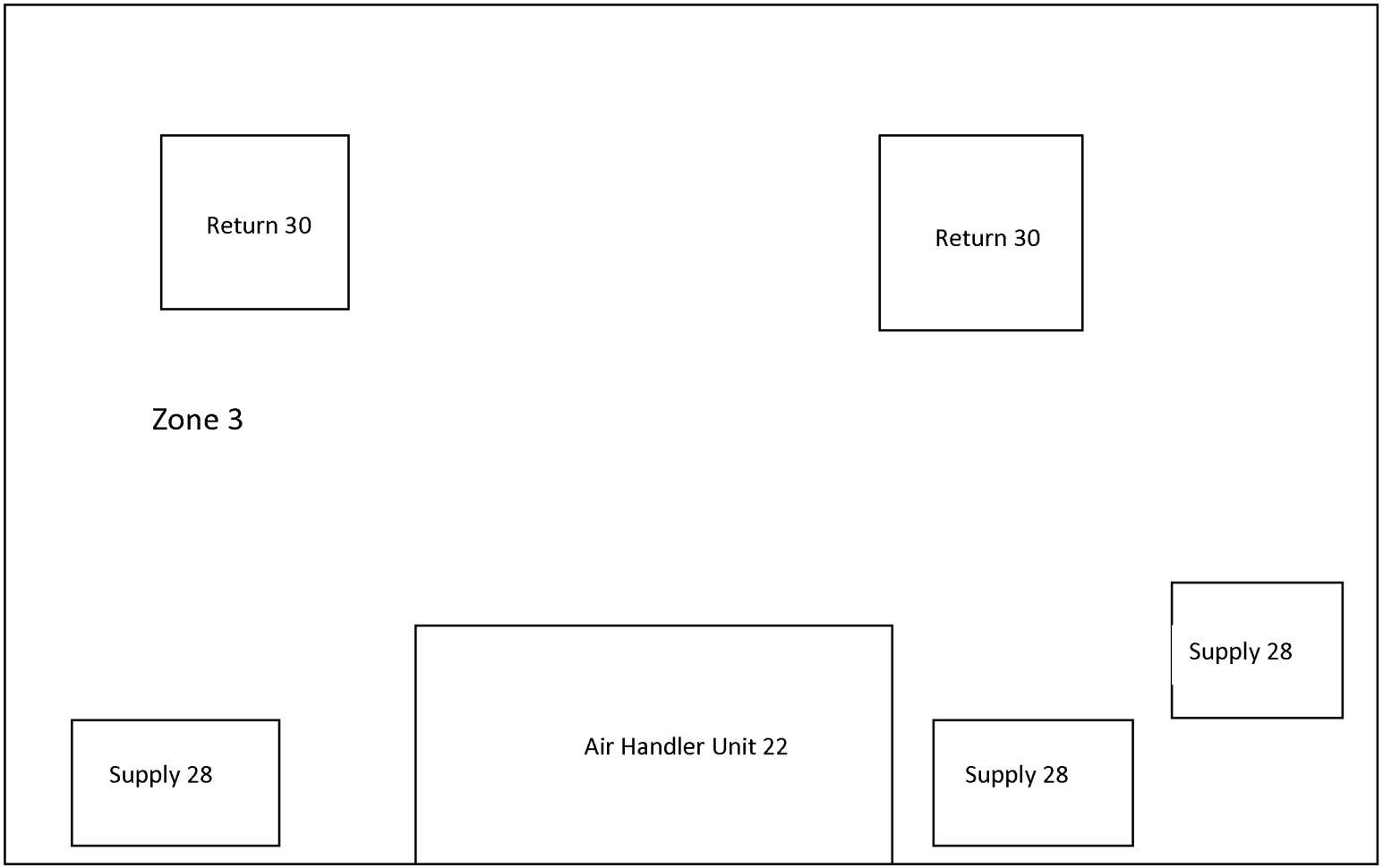
FIG. 8 is a schematic of the ducting system of zone 3 of the drying system of FIG. 1, in accordance with certain example embodiments.

FIGS. 4, 6, and 8 show the air handler unit 22 within each zone together with the location of the supply and exhaust/return vents 28 and 30. It will be understood that the supply and exhaust vents 28 and 30 are located within ducting that is located at the top of each zone. In another example embodiment, the ducting can be located in other portions of the zones (e.g., along the floor). In FIGS. 4, 6 and 8, the supply vent 28 closest to the air handler unit 22 ducts air directly to the air handler unit. The other two supply vents 30 supply air directly to the zone. The number of supply and exhaust/return vents 28 and 30 is not a limitation on the present invention. Any number of supply or exhaust/return vents are within the scope of the invention.

In certain example embodiments, the HVAC unit 20 is a BRY-AIR® Dehumidifier model VFB 150 that provides up to 16,500 CFM of process air at between about 68° F. to about 75° F. and between about 8% and about 14% relative humidity and at a dew point of between about 13° F. and about 18° F. In certain example embodiments, at least some of the process air from the HVAC unit is routed to the air handler units 22. Within each zone, the air handler unit 22 can check (via sensors) temperature, humidity, and dew point. Within the air handler unit 22, the air can be adjusted or conditioned so that it is at the desired temperature, humidity, and dew point and then it is released into the zone/room. In certain example embodiments, the air handler units 22 are CANATAL® air handler units that provide recirculation airflow within each zone to help prevent stagnant/stratification areas with each zone. The air handler units 22 each include a blower, heater and chiller therein for providing the desired air conditions and the desired air flow. As is described above, in certain example embodiments the air handler unit 22 in zone 1 is more powerful than the air handler units in zones 2 and 3. However, this is not a limitation on the present invention.

In certain example embodiments, the system includes a chiller 24 and pumping skid 26 that together provide cooled water to the HVAC unit 20 and air handler units 22 to help cool the process air as desired. In an exemplary embodiment, the chiller 24 is a CARRIER® chiller that provides chilled water at 35° F. that is piped to the pumping skid 26. In an exemplary embodiment, the pumping skid 26 includes two chilled water pumps with a chilled water storage tank. The pumps circulate the chilled water to chilled water coils in the HVAC unit 20 and each zone air handler unit 22. In FIG. 1, the water supply is represented by the arrows with solid lines and the air supply is represented by the arrows with dashed lines. The chilled water helps each air handler unit 22 to condition the air as desired and as detailed above.

Figure 9:
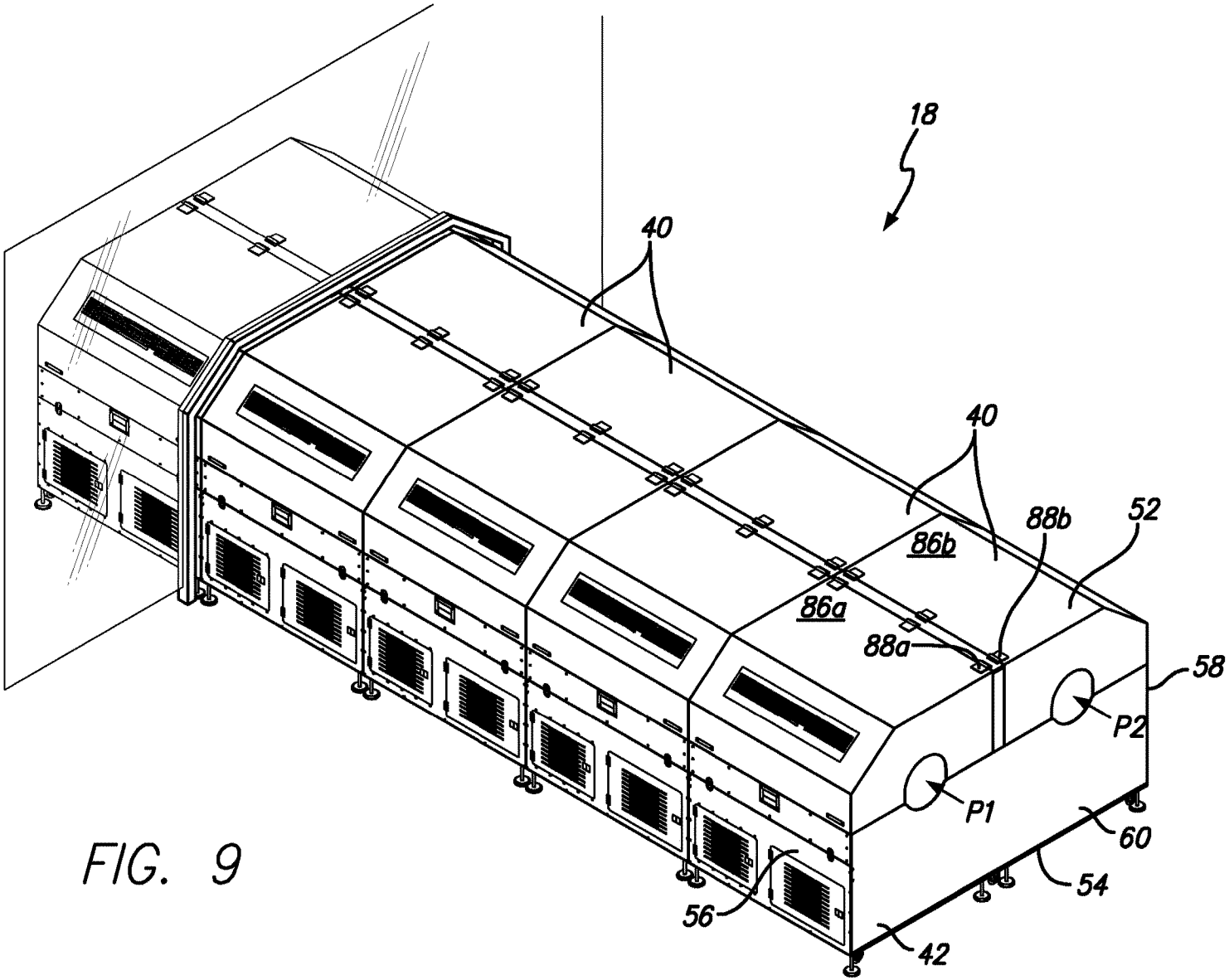
FIG. 9 is a perspective view of a series of dual tumble dryer units extending between zones 2 and 3, in accordance with certain example embodiments.

In certain example embodiments, the gelatin capsule drying system described herein includes a dryer/tumbler system, such as that described in U.S. Pat. No. 9,638,464, which is hereby incorporated herein by reference in its entirety. Briefly, with reference to FIGS. 9-12, shown is an embodiment of a tumble dryer unit 40 and tumble dryer line 18. As shown in FIG. 9, the system includes a plurality (e.g., fifteen) tumble dryers 40. FIG. 9 shows the line of tumble dryer line 18 extending from zone 1 into zone 2, for example.

Figure 10:
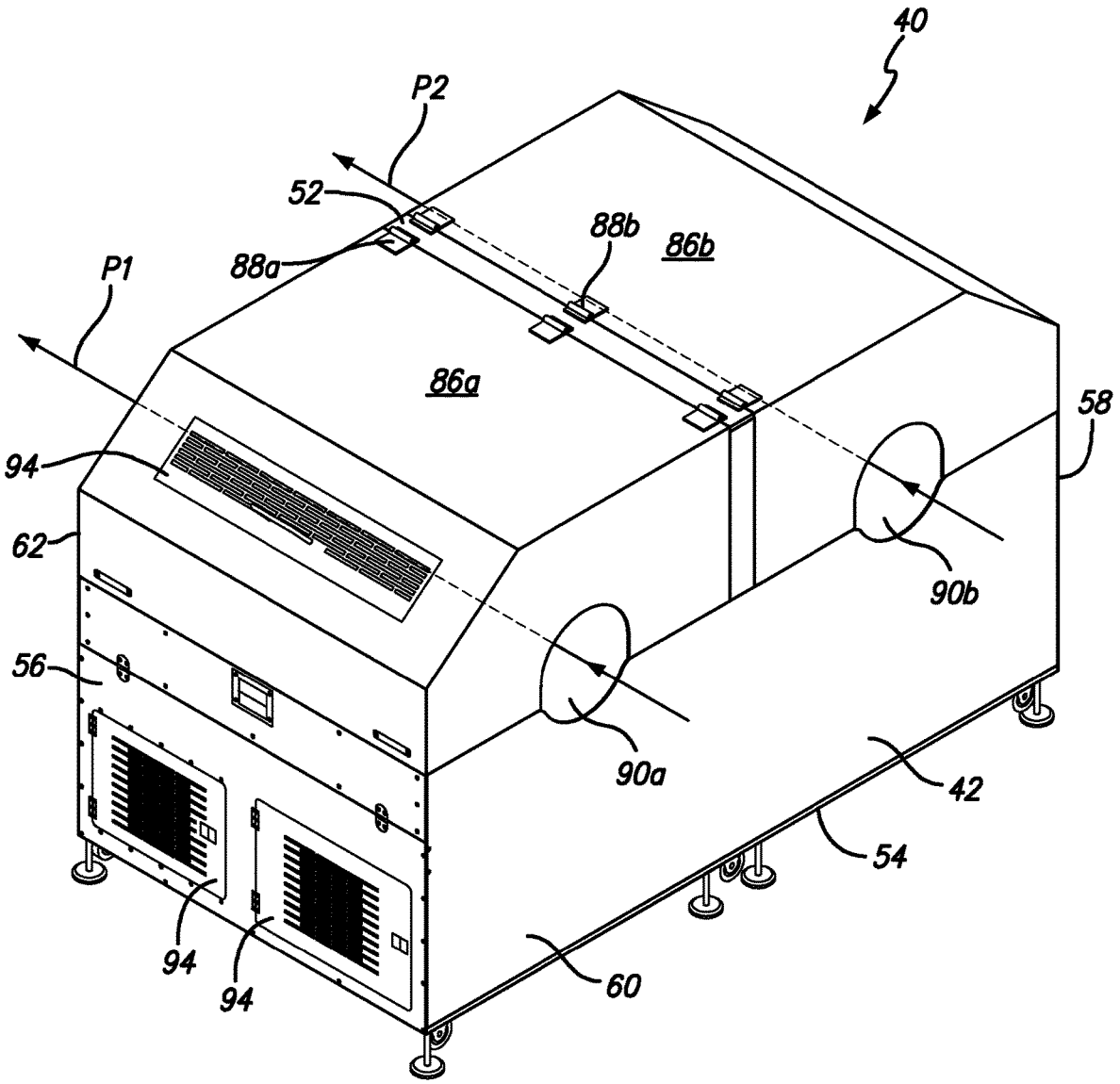
FIG. 10 is a perspective view of one of the dual tumble dryer units of FIG. 9, in accordance with certain example embodiments.
Figure 11:
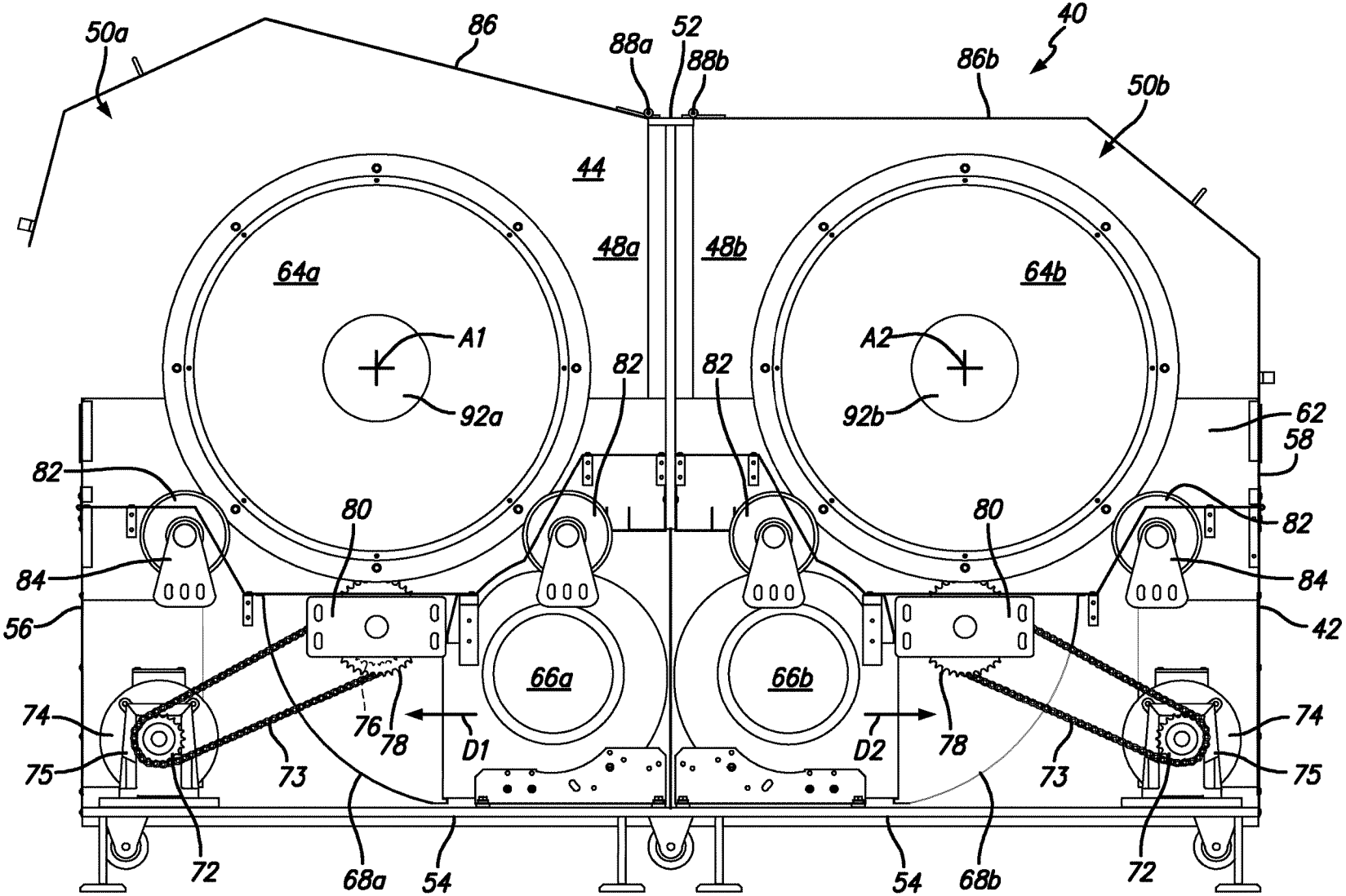
FIG. 11 is a cross-sectional side elevational view of the dual tumble dryer unit of FIG. 10, in accordance with certain example embodiments.
Figure 12:
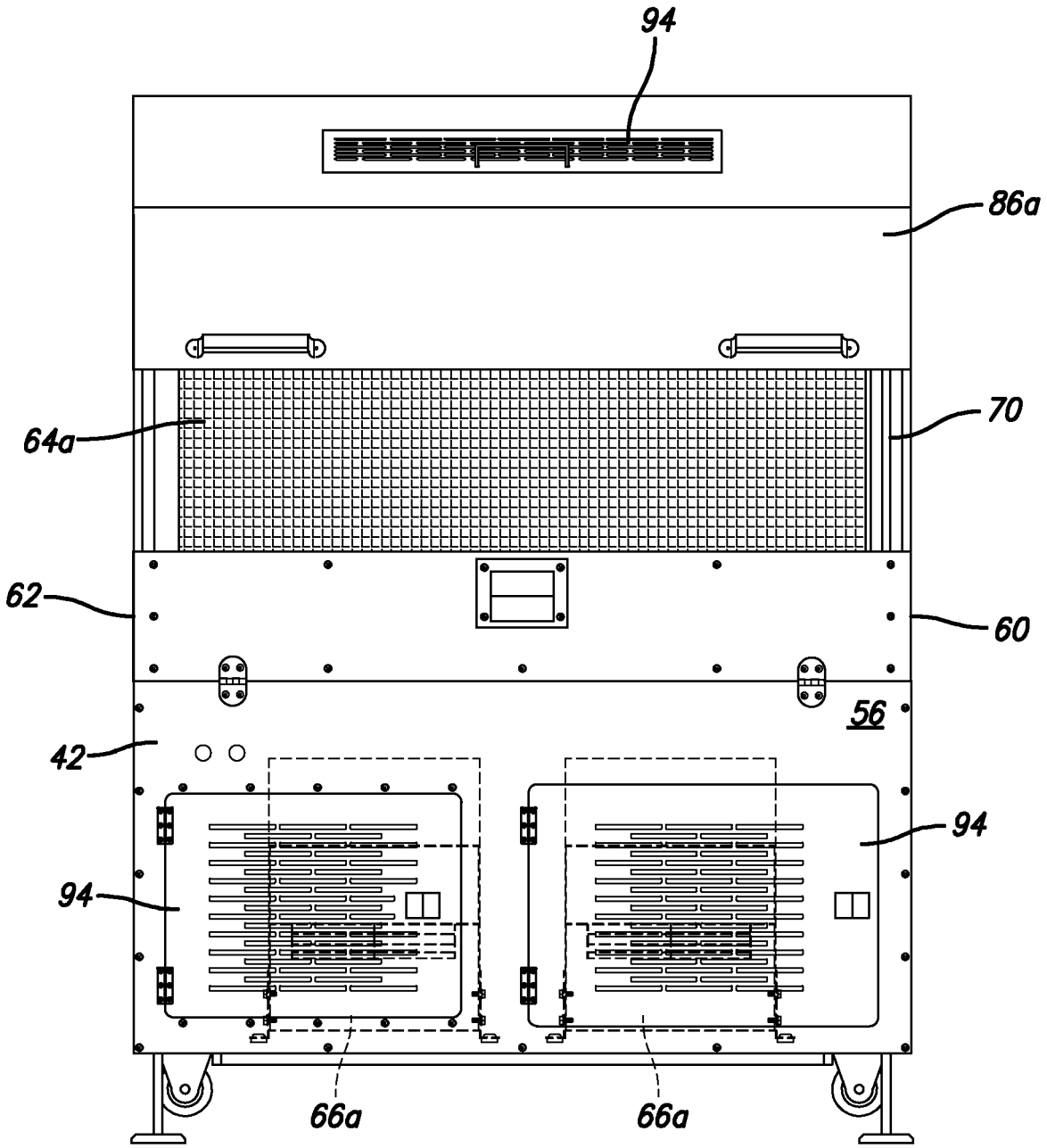
FIG. 12 is an end elevational view of the dual tumble dryer unit of FIG. 10 showing one of the covers partially open, in accordance with certain example embodiments.

As shown in FIGS. 10-12, in certain example embodiments each tumble dryer is a dual tumble dryer unit 40 that provides the ability to run two batches of softgels through the tumble dryer line simultaneously. A tumble dryer unit 40 generally includes a housing 42 that defines a housing interior 44, a divider 46 that divides the housing interior 44 into first and second sections 48*a* and 48*b* that include first and second dryer assemblies 50*a* and 50*b*.

The housing 42 includes a top 52, a bottom 54, first and second opposing end walls 56 and 58, and first and second opposing side walls 60 and 62 that cooperate to define the housing interior 44. The divider 46 extends between the first and second side walls 60 and 62. The first dryer assembly 50*a* includes a first basket 64*a* positioned to rotate about a first axis A1 (which is preferably horizontal, but does not have to be), and a first blower 66*a* positioned to blow air on the first basket 64*a*. The second dryer assembly 50*b* includes a second basket 64*b* positioned to rotate about a second axis A2 (which is preferably horizontal, but does not have to be), and a second blower 66*b* positioned to blow air on the second basket 64*b*. The first and second dryer assemblies 50*a* and 50*b* include first and second ramps 68*a* and 68*b* that each direct air from the associated blower onto associated basket. In certain example embodiments, each section includes two blowers. In other words, in certain example embodiments, the first section 48*a* includes two first blowers 66*a* (see FIG. 12) and the second section 48*b* includes two second blowers 66*b*).

As shown in FIG. 11, in certain example embodiments the first and second baskets 64*a* and 64*b* are each rotated by a first chain 70 and a plurality of gears. Each basket can be a wire mesh cylinder 71 wrapped with a second chain 73 at one end. The first chain 70 extends between a drive gear 72 (which is connected to an electric motor 74 and gearbox 75) and a first driven gear 76 that is coaxial with a second driven gear 78 that is engaged with the second chain 73 (or gear teeth) on the basket. As shown in FIG. 11, the second driven gear 78 is taller than the first driven gear 76. In operation, the drive gear 72 rotates the chain 70, which rotates the first driven gear 76, which rotates the second driven gear 78, which rotates the basket (64*a* or 64*b*). In certain example embodiments, the first and second driven gears 76 and 78 are rotatably mounted on a bracket 80 that is secured to one of the first or second side walls 60 or 62. In certain example embodiments, the first and second baskets 64*a* and 64*b* are rotatably supported on rollers 82 that are rotatably supported by brackets 84 that are secured to one of the first or second side walls 60 or 62.

As shown in FIG. 11, in certain example embodiments, the first dryer assembly 50*a* is essentially a mirror image of the second dryer assembly 50*b*. With this arrangement, the first blower 66*a* is configured to blow air in a first direction D1, and the second blower 66*b* is configured to blow air in a second direction D2, which is opposite the second direction. In certain example embodiments, the dual tumbler dryer unit 40 includes first and second covers 86*a* and 86*b* that are secured to the housing 42 by first and second hinges 88*a* and 88*b* respectively. It will be appreciated that the first and second hinges 88*a* and 88*b* can each be a single hinge unit or a plurality of axially aligned hinge units. The first and second covers 86*a* and 86*b* cover the first and second sections 48*a* and 48*b*, respectively. As shown in FIG. 11, in certain example embodiments, the first and second hinges 88*a* and 88*b* are connected to the housing 42 near or on the divider 46 and adjacent to one another such that the first and second covers 86*a* and 86*b* open in an opposed manner.

As shown in FIG. 10, in certain example embodiments, the dual tumble dryer unit 40 defines first and second drying paths P1 and P2. The first drying path P1 is defined between a first entry opening 90*a* defined in the first side wall 60, the first basket 64*a* and a first exit opening 92*a* defined in the second side wall 62. The second drying path P2 is defined between a second entry opening 90*b* defined in the first side wall 60, the second basket 64*b* and a second exit opening 92*b* defined in the second side wall 62. In certain example embodiments, the first drying path P1 extends generally parallel to the first axis A1 and the second drying path P2 extends generally parallel to the second axis A2. It will be appreciated that individual softgels will not necessarily move in a straight direction, but will enter the entry opening, be tumbled and then exit the exit opening. However, the path of each softgel generally follows the direction of P1 or P2.

It will be appreciated that the dual tumbler dryer unit 40 includes scoops for moving the softgels from one dual tumbler dryer unit 40 to the adjacent dual tumbler dryer unit 40. The dual tumbler dryer units also can include the ability to reverse the rotation direction of the baskets. It will be appreciated that the dual tumble dryer unit 40 may include access doors 94 or the like for access to different areas of the interior. Hinges, handles, etc. can be used therewith.

By drying hydrophilic softgels as described herein, the methods, systems, and processes herein can reduce the overall drying time that is conventionally needed for a hydrophilic softgel. For example, the total drying time for a hydrophilic softgel can be reduced from the conventional 5-7 days to less than about 24 hours. And importantly, such a reduced drying time can be accomplished without causing the hydrophilic softgel to shrivel to a raisin-like appearance. Hence, by using the methods, systems, and processes described herein, manufactures of softgels that include a hydrophilic fill material can greatly increase their hydrophilic softgel production capacity to meet consumer demands.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed, at different times. Further any specific numbers noted herein are only examples: alternative implementations may employ differing values or ranges.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Example Embodiments. While the above description describes certain embodiments of the disclosure, the teachings can be practiced in many ways. Details of the system may vary considerably in its implementation details, while still being encompassed by the subject matter disclosed herein.

What is claimed is:

1. A system for drying a softgel encapsulating a hydrophilic fill, the system comprising:

a structure divided into first, second and third zones;

a first air handler unit positioned to discharge air into the first zone, wherein the first air handler maintains the first zone at a temperature maintained between 35-45° F. and a dew point maintained between 0-8° F.;

a second air handler unit positioned to discharge air into the second zone, wherein the second air handler maintains the second zone at a temperature maintained between 60-67° F. and a dew point maintained between 0-16° F.;

and a third air handler unit positioned to discharge air into the third zone, wherein the third air handler maintains the third zone at a temperature maintained between 68-74° F. and a dew point maintained between 10-23° F.; and, a series of tumble dryers that extend from the first zone, through the second zone and into the third zone.

2. The system of claim 1, wherein the first zone has a relative humidity maintained between 15% and 22%.

3. The system of claim 2, wherein the second zone and third zones each have a relative humidity that is less than the relative humidity of the first zone.

4. The system of claim 2, wherein the second zone and the third zone have a relative humidity maintained between 10-15%.

5. The system of claim 1, wherein the first air handler unit outputs air into the first zone at about 4,000-7,000 cubic feet per minute (CFM), wherein the second air handler unit outputs air into the second zone at about 4,000-7,000 CFM; and, wherein the third air handler unit outputs air into the third zone at about 1,000-3,000 CFM.

6. The system of claim 5, wherein the first air handler unit outputs air into the first zone at about 5,500 cubic feet per minute (CFM), wherein the second air handler unit outputs air into the second zone at about 5,500 CFM, and wherein the third air handler unit outputs air into the third zone at about 2,000 CFM.

7. The system of claim 5, wherein the first air handler conditions the air before discharging the air into the first zone, wherein the second air handler conditions the air the before discharging the air into the second zone, and wherein the third air handler conditions the air before discharging the air into the third zone.

8. The system of claim 1, wherein the softgel comprises a shell, the shell comprising at least 5-15% sorbitol.

9. The system of claim 1, wherein the total drying time is less than about 30 hours.

10. The system of claim 9, wherein the total drying time is less than 17 hours.

11. A process for drying a hydrophilic softgel, comprising:

exposing a hydrophilic softgel to a first condition, wherein the first condition comprises a temperature of maintained between 35-45° F. and a dew point maintained between 0-8° F.;

after exposing the hydrophilic softgel to the first condition, exposing the hydrophilic softgel to a second condition, wherein the second condition comprises a temperature maintained between 60-67° F. and a dew point maintained between 0-16° F.; and, after exposing the hydrophilic softgel to the second condition, exposing the hydrophilic softgel to a third condition, wherein the third condition comprises a temperature maintained between 68-74° F. and a dew point maintained between 10-23° F.;

wherein the hydrophilic softgel remains in the second condition for about 8 to 12 hours.

12. The process of claim 11, wherein the first zone has a relative humidity maintained between 15% and 22%.

13. The process of claim 12, wherein the second zone and third zones each have a relative humidity that is less than the relative humidity of the first zone.

14. The process of claim 12, wherein the second zone and the third zone have a relative humidity maintained between 10-15%.

15. The process of claim 11, wherein the first condition comprises an airflow movement of about 4,000-7,000 cubic feet per minute (CFM), wherein the second condition comprises an airflow movement of about 4,000-7,000 CFM, and wherein the third condition comprises an airflow movement of about 1,000-3,000 CFM.

16. The process of claim 11, wherein the softgel comprises a shell, the shell comprising at least 5-15% sorbitol.

17. The process of claim 11 wherein the exposure of the hydrophilic softgel to the first, second, and third conditions comprises a total time of about 10 hours to about 30 hours.

18. The process of claim 11, wherein the hydrophilic softgel remains in the first condition for about 2 hours.

19. The process of claim 18, wherein the hydrophilic softgel remains in the third condition for about 3 hours.

20. The process of claim 11, wherein a first drying zone is preselected to have the first conditions, a second drying zone is preselected to have the second conditions, and a third drying zone is preselected to have the third conditions, and the process comprises sequentially moving the hydrophilic softgel into and through the first drying zone, into and through the second drying zone, and into and through the third drying zone.

* * * * *